US007506490B1

(12) United States Patent
Yohe et al.

(10) Patent No.: US 7,506,490 B1
(45) Date of Patent: Mar. 24, 2009

(54) SYSTEM AND METHOD FOR PACKAGING ARTICLE LAYERS

(75) Inventors: Peter D. Yohe, Bloomsburg, PA (US); Ronald H. Cordingly, Berwick, PA (US); Timothy D. Hoffman, Bloomsburg, PA (US)

(73) Assignee: Dyco, Inc., Bloomsburg, PA (US)

( * ) Notice: Subject to any disclaimer, the term of this patent is extended or adjusted under 35 U.S.C. 154(b) by 16 days.

(21) Appl. No.: 11/849,619

(22) Filed: Sep. 4, 2007

(51) Int. Cl.
*B65B 35/56* (2006.01)

(52) U.S. Cl. ..... 53/446; 53/449; 53/495; 53/544

(58) Field of Classification Search ..... 53/448, 53/446, 48.1, 495, 542, 543, 544
See application file for complete search history.

(56) References Cited

U.S. PATENT DOCUMENTS

| | | | | | |
|---|---|---|---|---|---|
| 3,407,563 | A | | 10/1968 | Dieter et al. | |
| 3,555,770 | A | * | 1/1971 | Rowekamp | 53/495 |
| 3,559,364 | A | | 2/1971 | Petrella et al. | |
| 3,600,871 | A | | 8/1971 | Farquher | |
| 3,802,154 | A | | 4/1974 | Dillon | |
| 3,881,089 | A | | 4/1975 | Harkness et al. | |
| 3,882,655 | A | | 5/1975 | Monaghan | |
| 3,984,964 | A | * | 10/1976 | Stoll | 53/543 |
| 4,041,677 | A | | 8/1977 | Reid | |
| 4,771,589 | A | * | 9/1988 | Mueller et al. | 53/446 |
| 4,864,801 | A | * | 9/1989 | Fallas | 53/446 |
| 4,897,980 | A | | 2/1990 | Guyser et al. | |
| 4,901,502 | A | | 2/1990 | Colamussi | |
| 5,412,923 | A | | 5/1995 | Lashyro et al. | |
| 5,439,110 | A | * | 8/1995 | Regan, II | 206/427 |
| 5,477,663 | A | | 12/1995 | Smith et al. | |
| 5,555,706 | A | * | 9/1996 | Maoloni et al. | 53/447 |
| 5,622,031 | A | * | 4/1997 | Meives | 53/473 |
| 5,732,536 | A | * | 3/1998 | Lin et al. | 53/535 |
| 5,735,104 | A | | 4/1998 | Odenthal | |
| 5,765,336 | A | | 6/1998 | Neagle et al. | |
| 6,089,001 | A | | 7/2000 | Hurst | |
| 6,164,045 | A | * | 12/2000 | Focke et al. | 53/543 |
| 6,769,230 | B2 | | 8/2004 | Handa et al. | |
| 6,948,293 | B1 | * | 9/2005 | Eckermann et al. | 53/246 |
| 7,219,485 | B2 | * | 5/2007 | Battisti | 53/542 |

FOREIGN PATENT DOCUMENTS

| | | |
|---|---|---|
| DE | 3812205 | 10/1989 |

* cited by examiner

*Primary Examiner*—Paul R Durand
(74) *Attorney, Agent, or Firm*—McNees Wallace & Nurick, LLC

(57) ABSTRACT

A system for packaging articles includes a first collection area for receiving and arranging a plurality of articles having a substantially non-uniform geometry. A transport device is included and a consolidation area for constructing an article layer, each article layer constructed from the plurality of arranged articles transported from the first collection area by the transport device. The consolidation area includes a stabilizer providing substantially continuous lateral support along the periphery of arranged articles of the article layer being constructed to substantially prevent tipping of the plurality of arranged articles. A portion of the arranged articles transported by the transport device is oriented differently from the other arranged articles.

18 Claims, 24 Drawing Sheets

SYSTEM AND METHOD FOR PACKAGING ARTICLE LAYERS

FIELD OF THE INVENTION

The present invention is directed to a system and method for packaging article layers, and specifically to a system and method for packaging article layers for articles having substantially non-uniform geometries.

BACKGROUND OF THE INVENTION

When large numbers of stackable articles must be transported in large quantities to another location, especially when the article is small, the article may be packaged in a container to protect the article during shipping of the container. Alternately, to reduce the amount of handling required, the articles may be arranged in a tight grouping, or array of articles. Each array of articles can form a layer of articles that can be stacked on a pallet having a footprint which can be accommodated by freight hauling compartments, e.g., for truck, rail, sea or air vessels.

Palletizing articles is becoming increasingly automated in manufacturing facilities, wherein articles are moved via a conveyor, which articles are manipulated by robots onto pallets. Such processing may work well if the articles are inherently stable, i.e., having a broad base footprint and low center of gravity, which articles being resistant to tipping. However, there can be difficulties associated with elongated articles having a small base footprint, as such articles are susceptible to tipping. Moreover, problems associated with tipping articles are significantly increased when the articles are especially lightweight, such as empty articles, that are shipped to locations for filling the articles with product.

Assembly of article arrays is currently performed using conventional bulk palletizers. Most conventional bulk palletizers build the complete article array or bulk array or article layer and then move or "sweep" the completed array layer or bulk array into position onto the pallet. Palletizing robots are also used, but most palletizing robots also move the completed article layer or bulk array onto the pallet. Alternately, the palletizing robots construct an article array by placing individual rows of articles to form the array. However, the previously discussed problems associated with article tipping have not been resolved. In addition, the conventional palletizer constructions are difficult to be quickly and cost effectively re-configured to accommodate different article designs or array patterns.

As shown in FIG. 1, articles 12 having non-uniform geometries pose additional challenges, as they are prone to tipping, even when supported along the collective periphery of the article array or layer. Currently, empty articles having non-uniform geometry are typically transported to packaging facilities using two techniques. In a first technique, the articles are loosely loaded en masse into a container having a liner. This technique results in a random, inconsistent and inefficient arrangement of the articles in the container. With the other technique, a rectangular container to be filled with articles is disposed at an angle from a horizontal plane. The container, either manually or with aid of a robotic arm, is loaded with rows of articles that are alternatively inverted, providing a consistent, improved container arrangement. However, both approaches have the disadvantage of having to dispose of both the container and the container liner.

What is needed is an apparatus and method that effectively package articles having non-uniform geometries while substantially eliminating the possibility of articles tipping during packaging, that also eliminates the need for both a container and container liner for article layers and for palletized article layers.

SUMMARY OF THE INVENTION

The present invention relates to a method for packaging articles. The steps include arranging a plurality of articles having a substantially non-uniform geometry within a first collection area and transporting the plurality of articles from the first collection area to a consolidation area for constructing an article layer. The method further includes laterally supporting the periphery of the plurality of articles arranged within the consolidation area to substantially prevent tipping of the plurality of articles and arranging a subsequent plurality of articles within the first collection area. The method further includes transporting the subsequent plurality of articles from the first collection area to the consolidation area adjacent the plurality of arranged articles, the periphery of the plurality of arranged articles being continuously laterally supported while the subsequent plurality of articles is being arranged. The orientation of the subsequent plurality of articles is different than the orientation of the plurality of arranged articles. Upon the arrangement of the subsequent plurality of articles, the periphery of the plurality of arranged and subsequently arranged articles is laterally supported. The method further includes repeating the arranging and transporting steps for subsequent plurality of articles until the article layer is constructed and substantially enclosing the article layer in a layer of resilient material substantially maintaining the arrangement of the article layer.

The present invention further relates to a system for packaging articles including a first collection area for receiving and arranging a plurality of articles having a substantially non-uniform geometry. A transport device is included and a consolidation area for constructing an article layer, each article layer constructed from the plurality of arranged articles transported from the first collection area by the transport device. The consolidation area includes a stabilizer providing substantially continuous lateral support along the periphery of arranged articles of the article layer being constructed to substantially prevent tipping of the plurality of arranged articles. A portion of the arranged articles transported by the transport device is oriented differently from the other arranged articles.

An advantage of the present invention is that article layers of articles having non-uniform geometry are substantially prevented from tipping.

A further advantage of the present invention is that article layers of articles having non-uniform geometry can be enclosed in a resilient layer of material, not requiring a container.

A yet further advantage of the present invention is that the arrangement of the articles of an article layer is substantially similar to the arrangement of an enclosed article layer.

A still further advantage of the present invention is that enclosed article layers of articles having non-uniform geometry can be arranged on a pallet.

The present invention encloses article layers of articles having non-uniform geometry without requiring a container.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
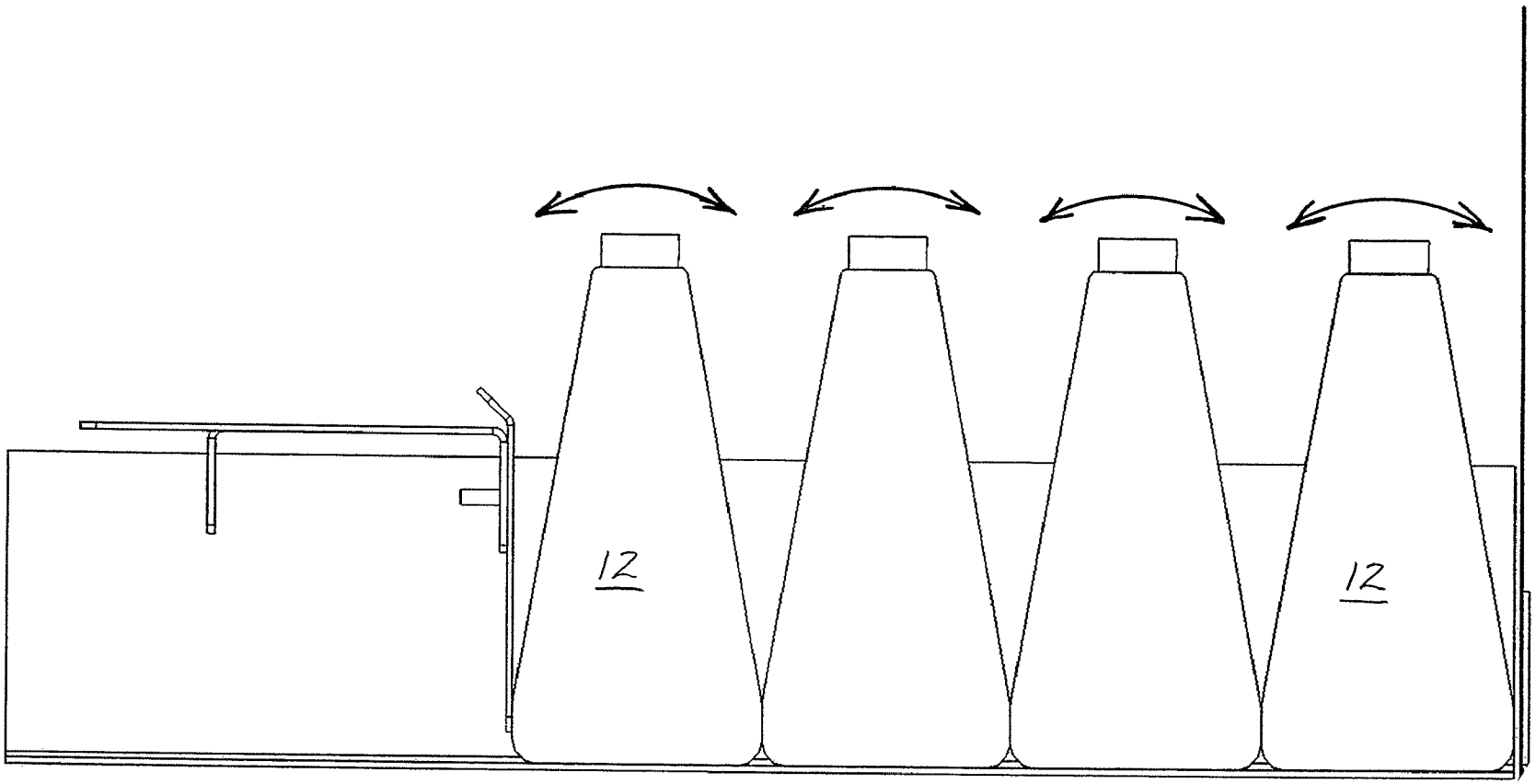
FIG. 1 is an elevation view of articles having non-uniform geometries for use with the present disclosure.
Figure 2:
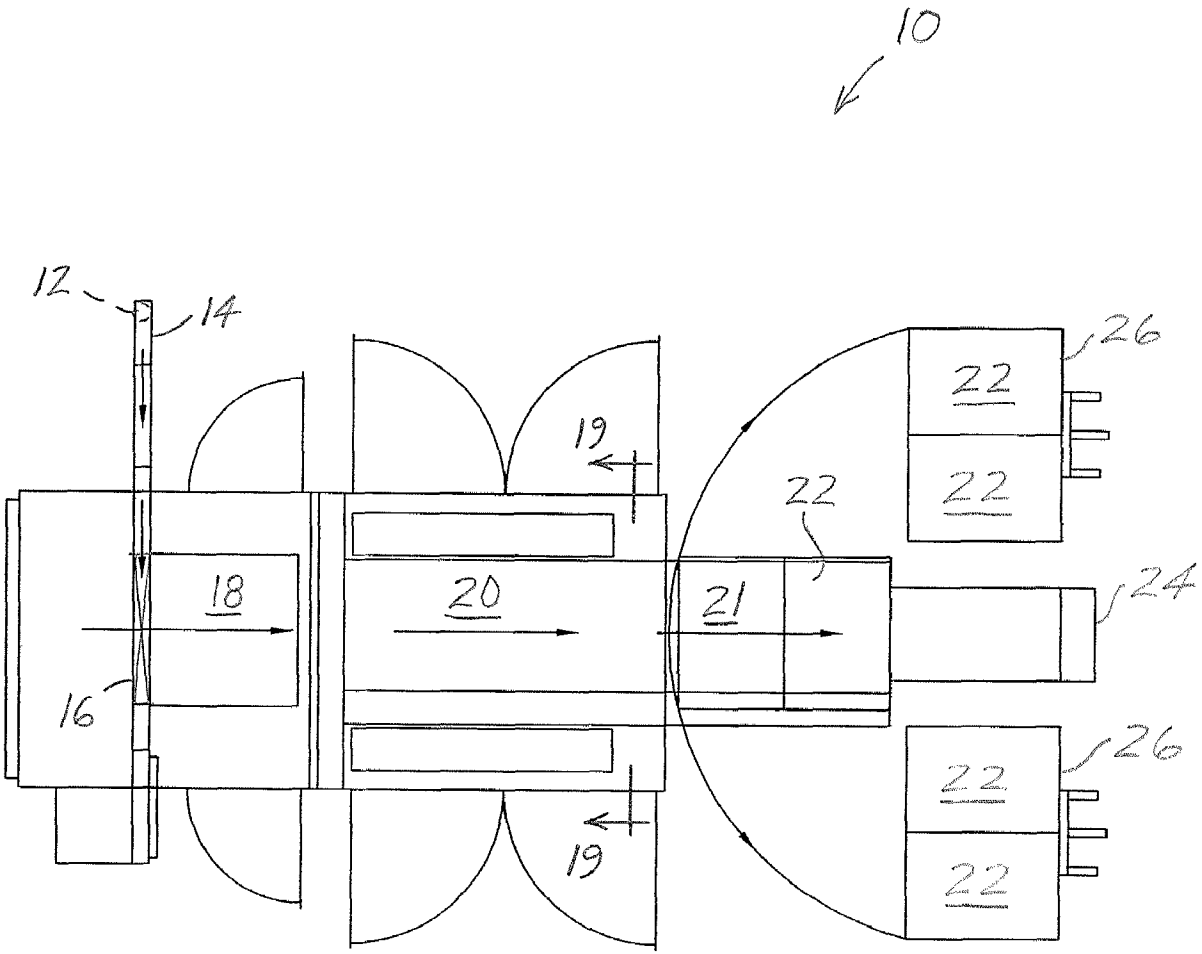
FIG. 2 is a schematic of an embodiment of an article packaging system of the present disclosure.
Figure 3:
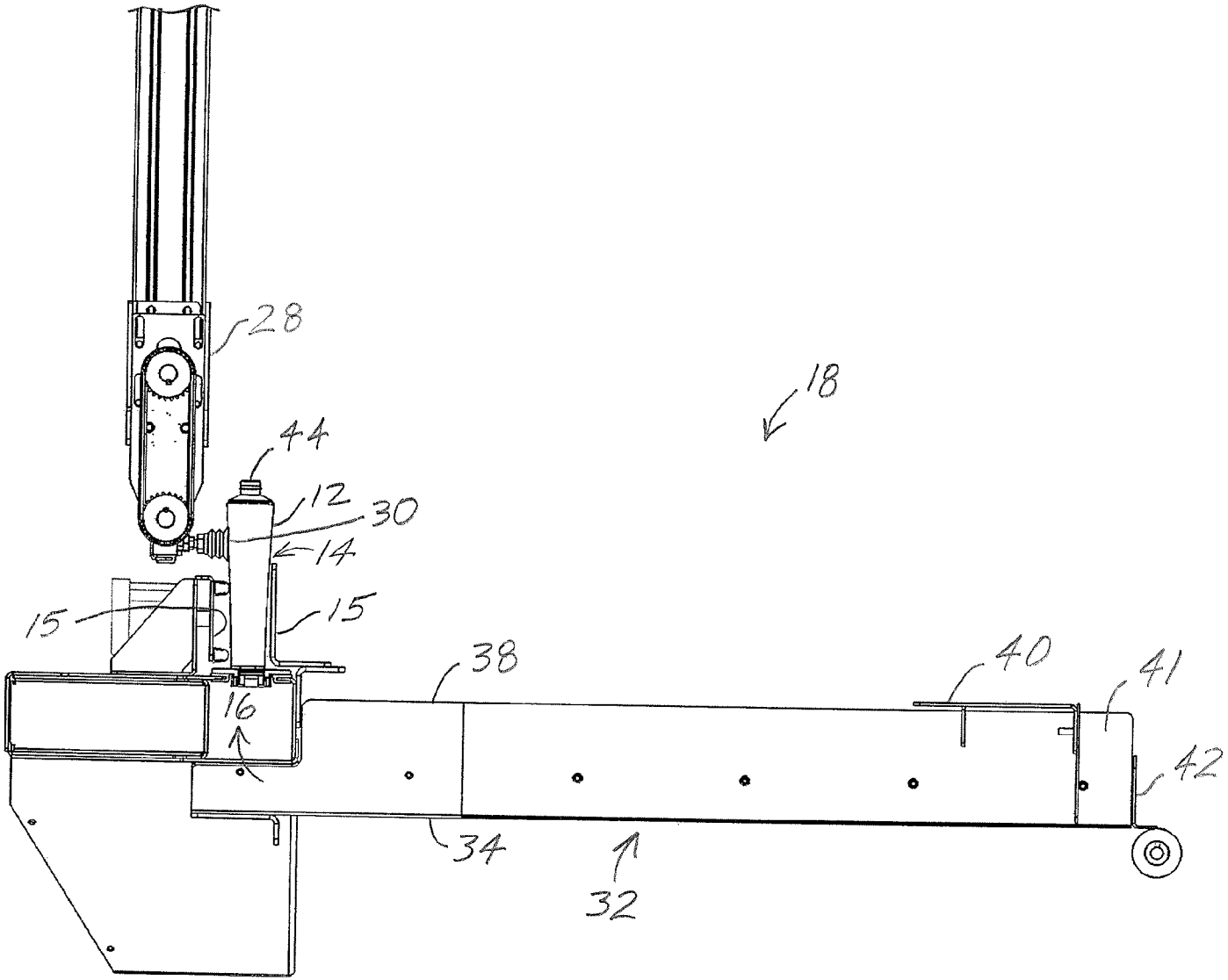
FIG. 3 is a partial cutaway of an elevation view of an embodiment of a consolidation area of the present disclosure.
Figure 15:
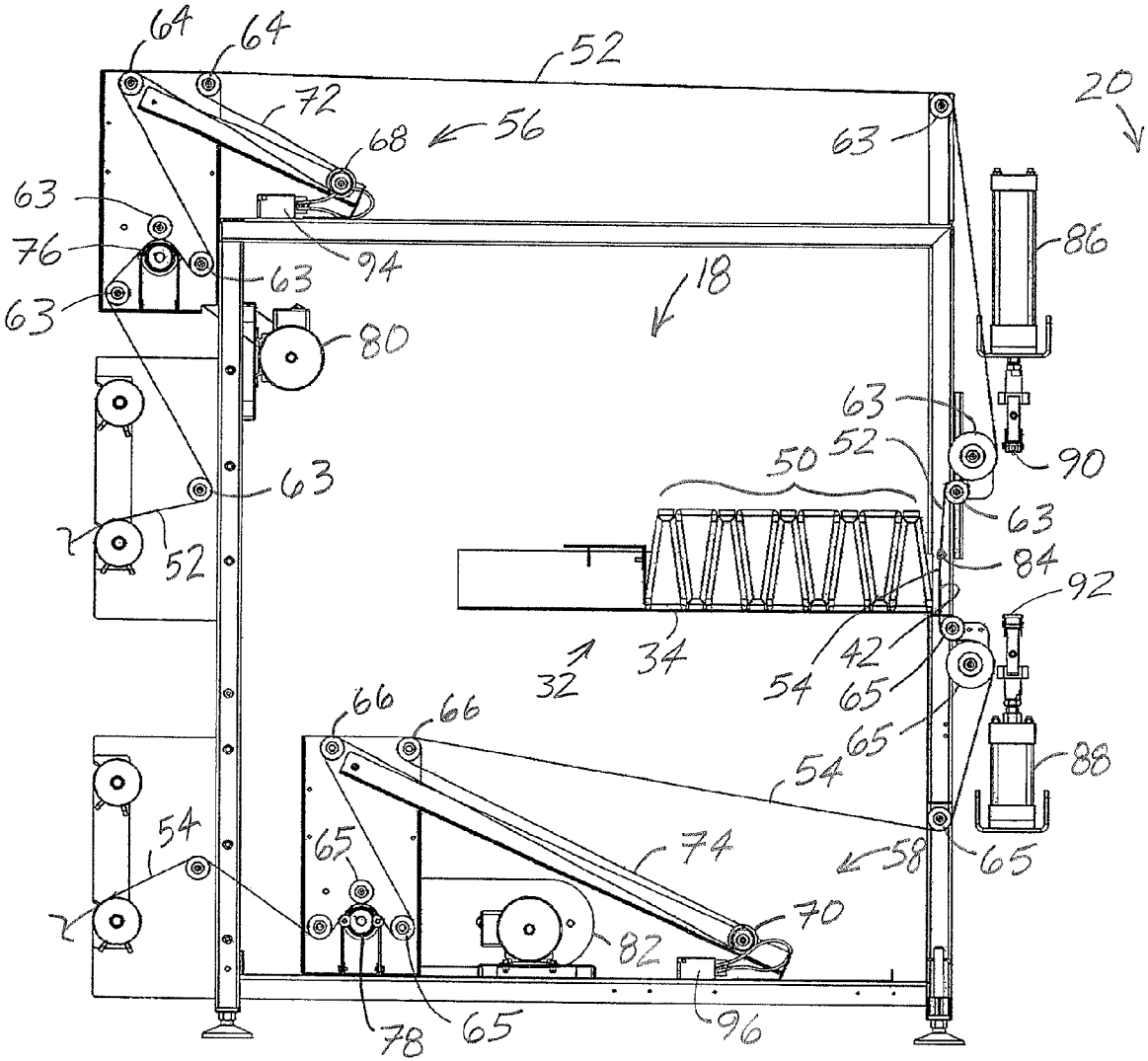
FIG. 15 is an elevation view of an embodiment of the juncture of the consolidation/bagging areas of the present disclosure.

The present disclosure includes a system 10 and method for packaging articles 12 (FIG. 1) having a substantially non-uniform geometry as shown in FIG. 2. In article packaging system 10, articles 12 are guided along a conveyor 14 to a collection area 16. The articles 12 are then transported by a robot, e.g., robotic arm 28 (FIG. 3) from collection area 16 to a consolidation area 18 that includes a stabilizer 32 (FIG. 3) for providing lateral support for articles 12 supplied to the consolidation area 18. Robotic arm 28 further transports articles 12 from collection area 16 to consolidation area 18 to construct an article layer 50 (FIG. 15). A portion of the articles 12 of article layer 50 are oriented differently than other portions of article layer 50, as will be discussed in further detail, resulting in increased volumnar density of the article layer. Once article layer 50 has been constructed, the article layer 50 is moved from consolidation area 18 to bagging area 20 to substantially enclose the article layer in a layer of resilient material, such as plastic wrap (see FIG. 23). In one embodiment, resilient material layers 52, 54 are applied to corresponding portions of opposite ends of article layer 50 to form a bagged or enclosed article array or layer 22. After article array or layer 22 is formed in bagging area 20, the article array or layer 22 is moved to an unloading area 21 and moved by a stacking device 24 onto a pallet 26.

As used herein, the term "substantially non-uniform geometry" is intended to refer to articles, such as articles 12 in FIG. 1, which are not configured to form an article layer of stable construction when the articles are substantially oriented in a like manner. In one embodiment, articles 12 have a tapered profile in one direction, i.e., having a narrow dimension along a base of the article, increasing to a larger dimension adjacent to a top of the article. As can be appreciated by those skilled in the art, and inspection of FIG. 1, this difference in dimensions between the base and top of the article renders an article layer constructed with similarly oriented articles 12 unstable, e.g., prone to tipping, even when the article layer is laterally supported along its collective periphery. In addition, the term "substantially non-uniform geometry" includes article constructions that are asymmetrical as well as symmetrical about a reference axis or plane.

As shown in FIGS. 3-7, which includes a partial cutaway of stabilizer 32, an end effector 30, such as associated with a pneumatic source (not shown) of robotic arm 28, engages article 12 disposed on collection area 16 (FIG. 2) along conveyor 14. In one embodiment, robotic arm 28 includes a plurality of end effectors 30, each engaging a corresponding article 12 forming article row 44 that is disposed on collection area 16. Opposing supports 15 provide lateral support for articles 12 directed along conveyor 14. Adjacent to collection area 16 is a stabilizer 32 that includes a retaining tray 34 having opposed sides 36, 38 as more fully shown in FIG. 7 (FIGS. 3-6 and 8-14 do not show side 36 of tray 34 for clarity). In one embodiment, stabilizer 32 further includes a stabilizer bar 40 and a backstop 42 which are each independently movable with respect to tray 34. That is, stabilizer bar 40 moves toward/away from backstop 42, and backstop 42 rotates (see FIG. 16) sufficiently out of the way to permit tray 34, including stabilizer bar 40 to move from consolidation area 18 to bagging area 20. A supporting region 41 is defined by stabilizer bar 40, backstop 42 and sides 36, 38 of tray 34 to provide peripheral lateral support for article row 44 placed in the supporting region 41.

Hereafter, although the Figures show elevation views that may appear as a single article, it is to be understood that the same views may also apply to article rows. Thus, as a general matter, the terms article and article rows may be used interchangeably.

Figure 4:
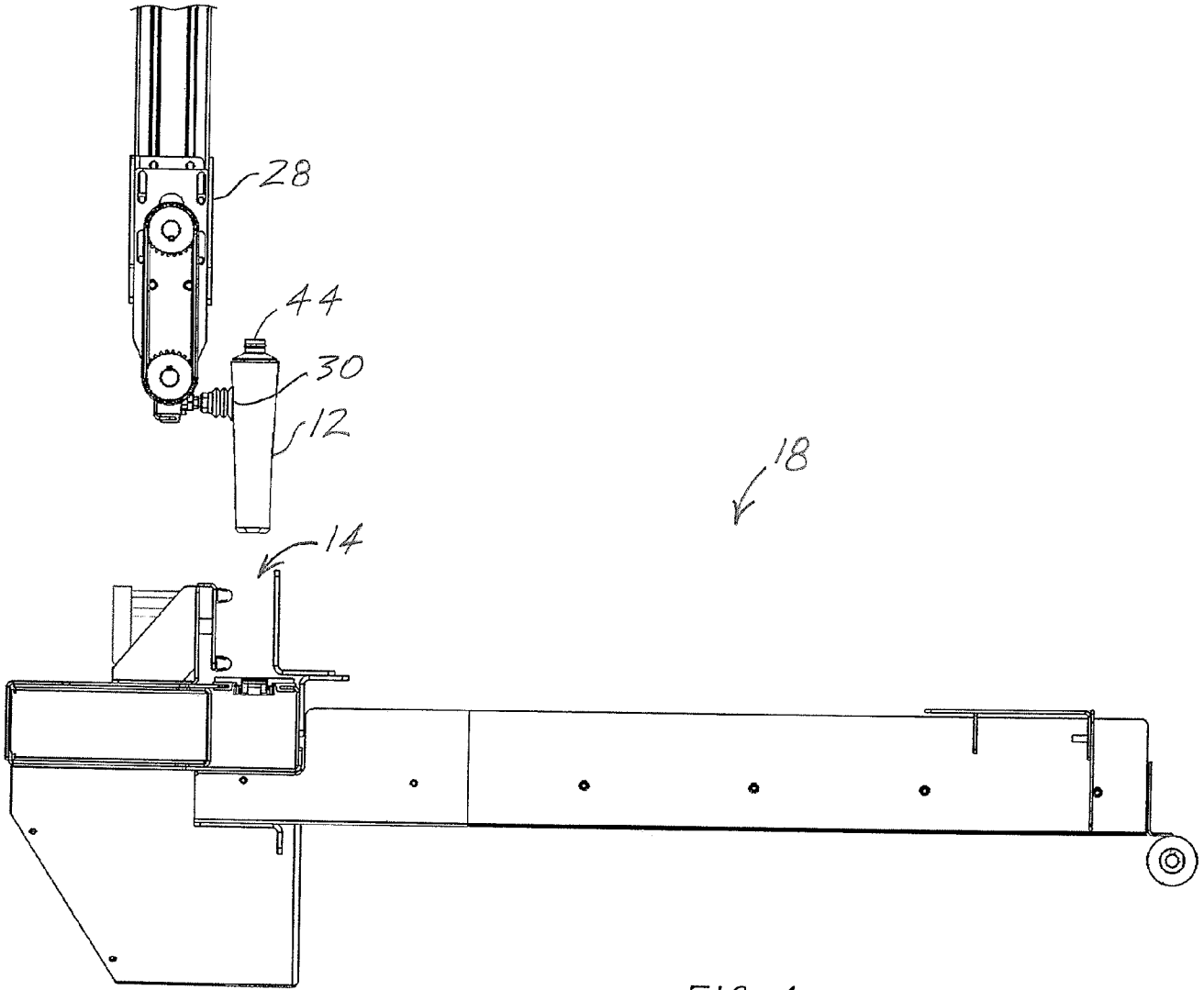
FIGS. 4-6 show sequential steps in the operation of an embodiment of article layer construction of FIG. 3 having a lateral support system of the present disclosure.
Figure 5:
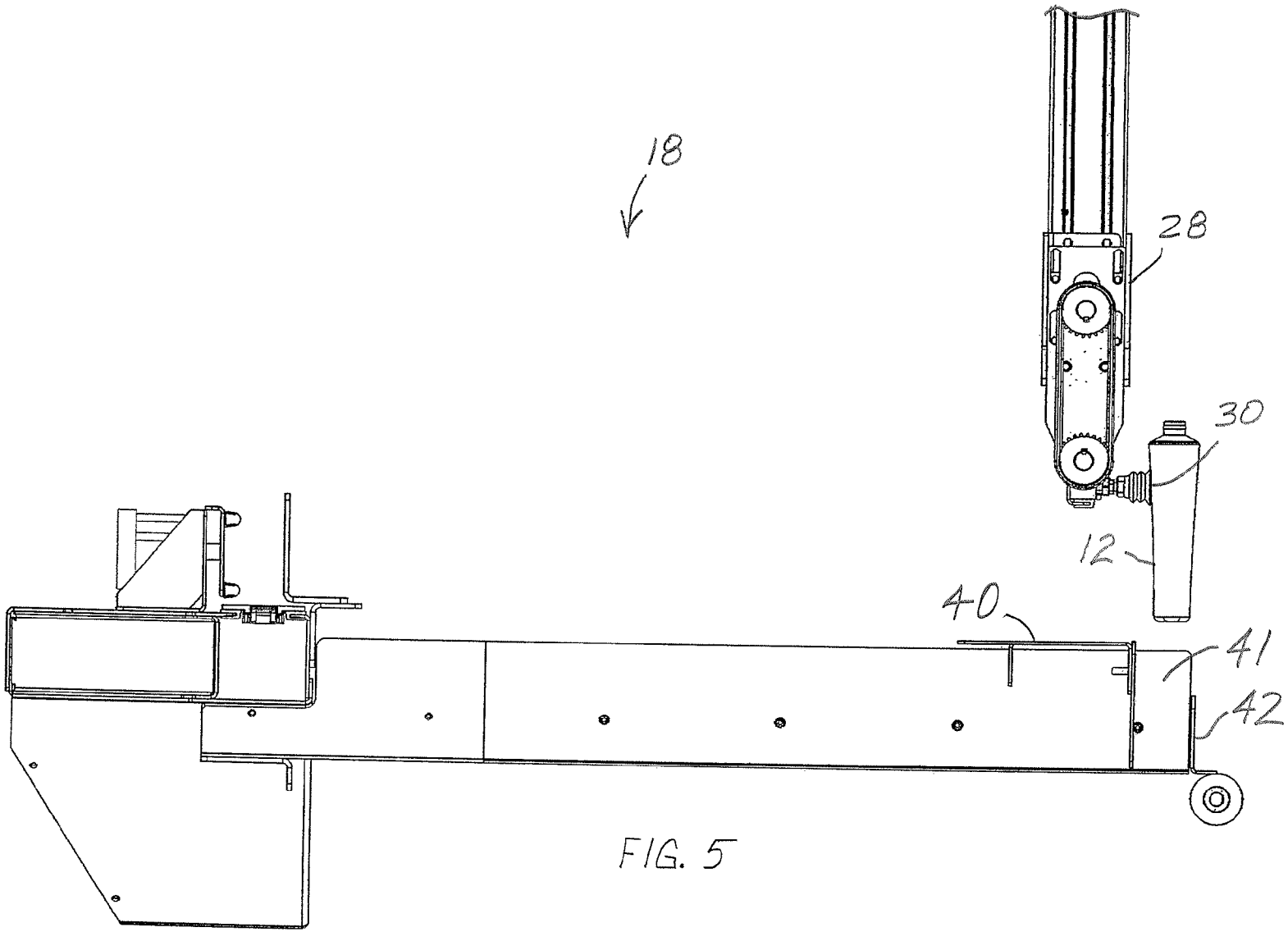
Figure 6:
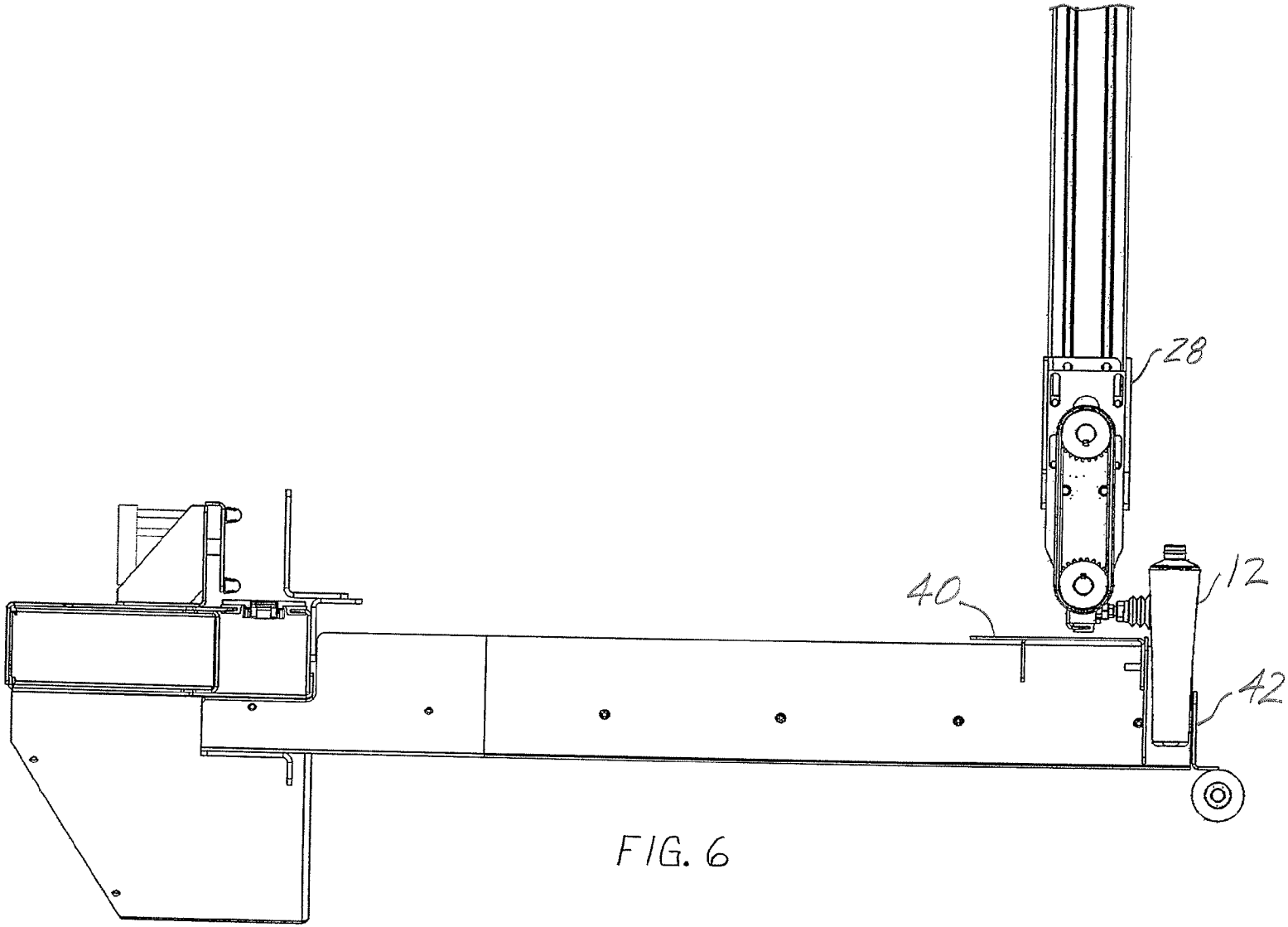
Figure 7:
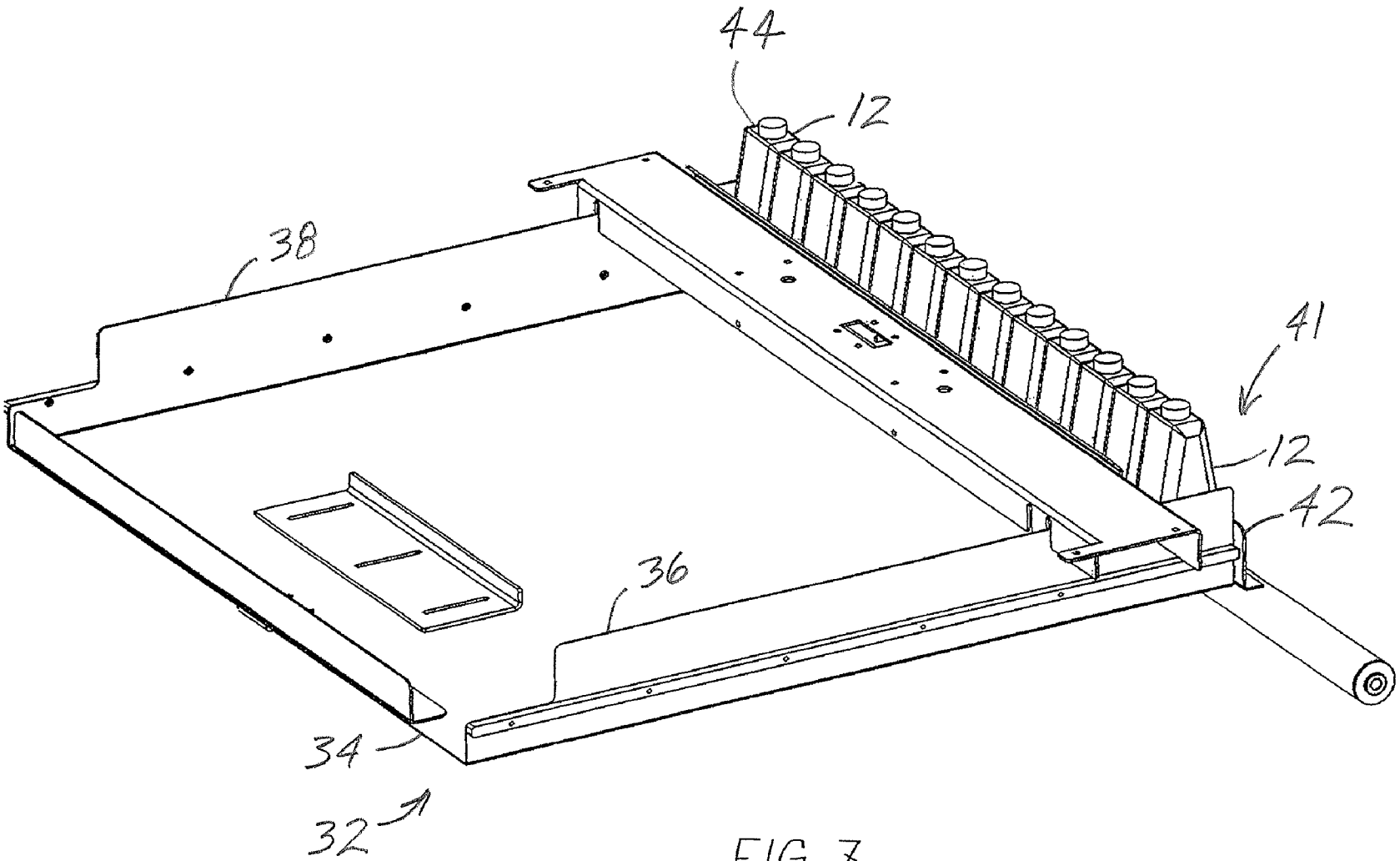
FIG. 7 is a perspective view of the consolidation area of FIG. 3 containing a row of articles of the present disclosure.

As shown in FIGS. 4-6, each article 12 of article row 44, which is engaged to a corresponding end effector 30, is raised from collection area 16 (FIG. 2) and guided by robotic arm 28 to supporting region 41. FIG. 7 shows article row 44 laterally secured in supporting region 41.

Figure 8:
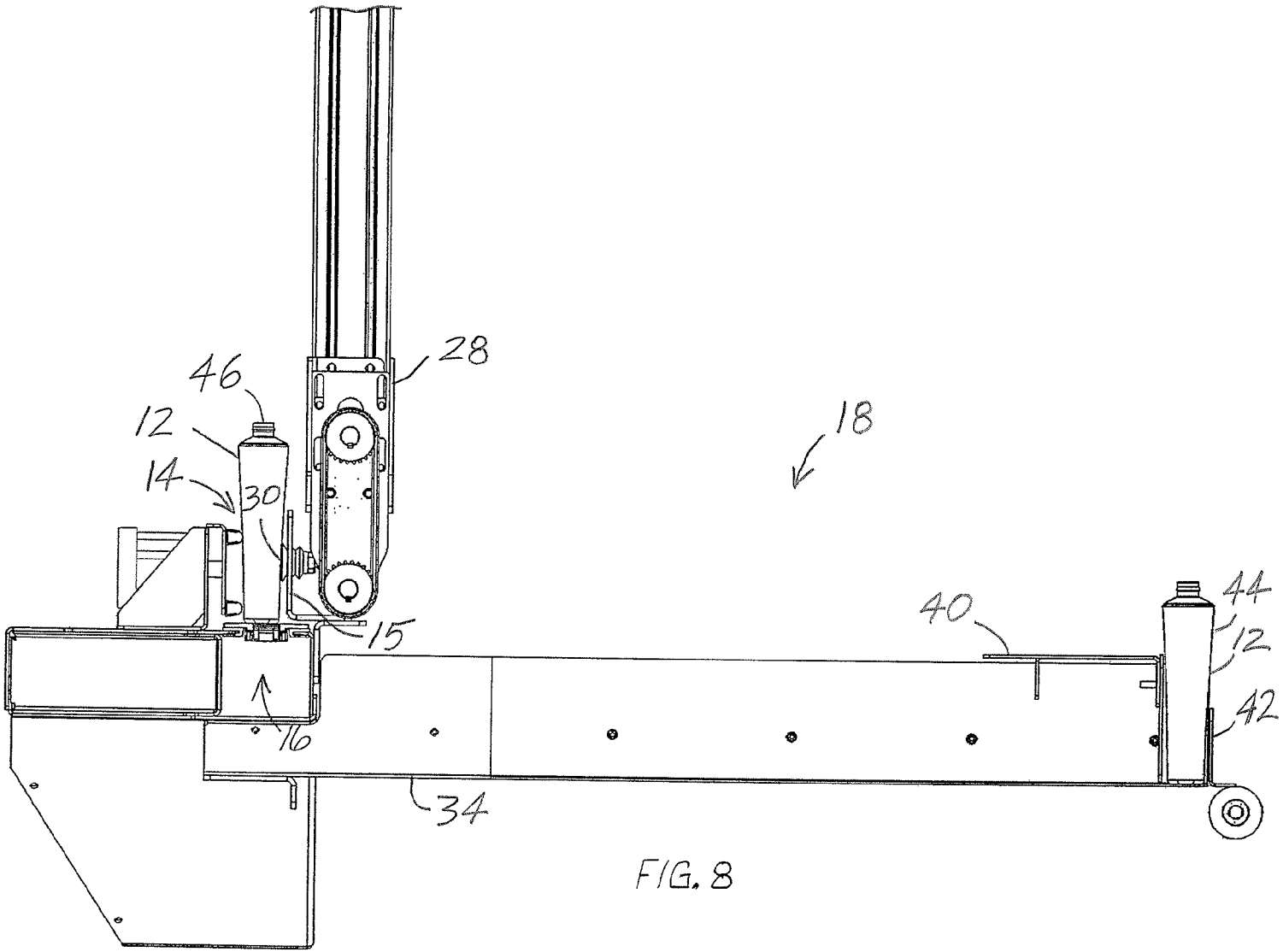
FIGS. 8-14 show sequential steps in the operation of an embodiment of article layer construction of FIG. 3 having a lateral support system of the present disclosure.

As shown in FIGS. 8-12, a second article row 46 is added toward construction of an article layer 50 (e.g., FIG. 15). In one embodiment, alternating article rows are engaged differently at collection area 16. That is, each article 12 of article row 44 (FIG. 3) is engaged from an upper portion of a side of article 12 facing away from consolidation area 18. In contrast, as shown in FIG. 8, each article 12 of article row 46 (FIG. 8) is engaged from a lower portion of a side of article 12 facing toward consolidation area 18. Although not specifically shown, support 15 contains discontinuities, such as slots, permitting end effectors 30 to engage corresponding articles 12 of article row 46, and further permitting robotic arm 28 to raise each article 12 of article row 46 from collection area 16.

Figure 9:
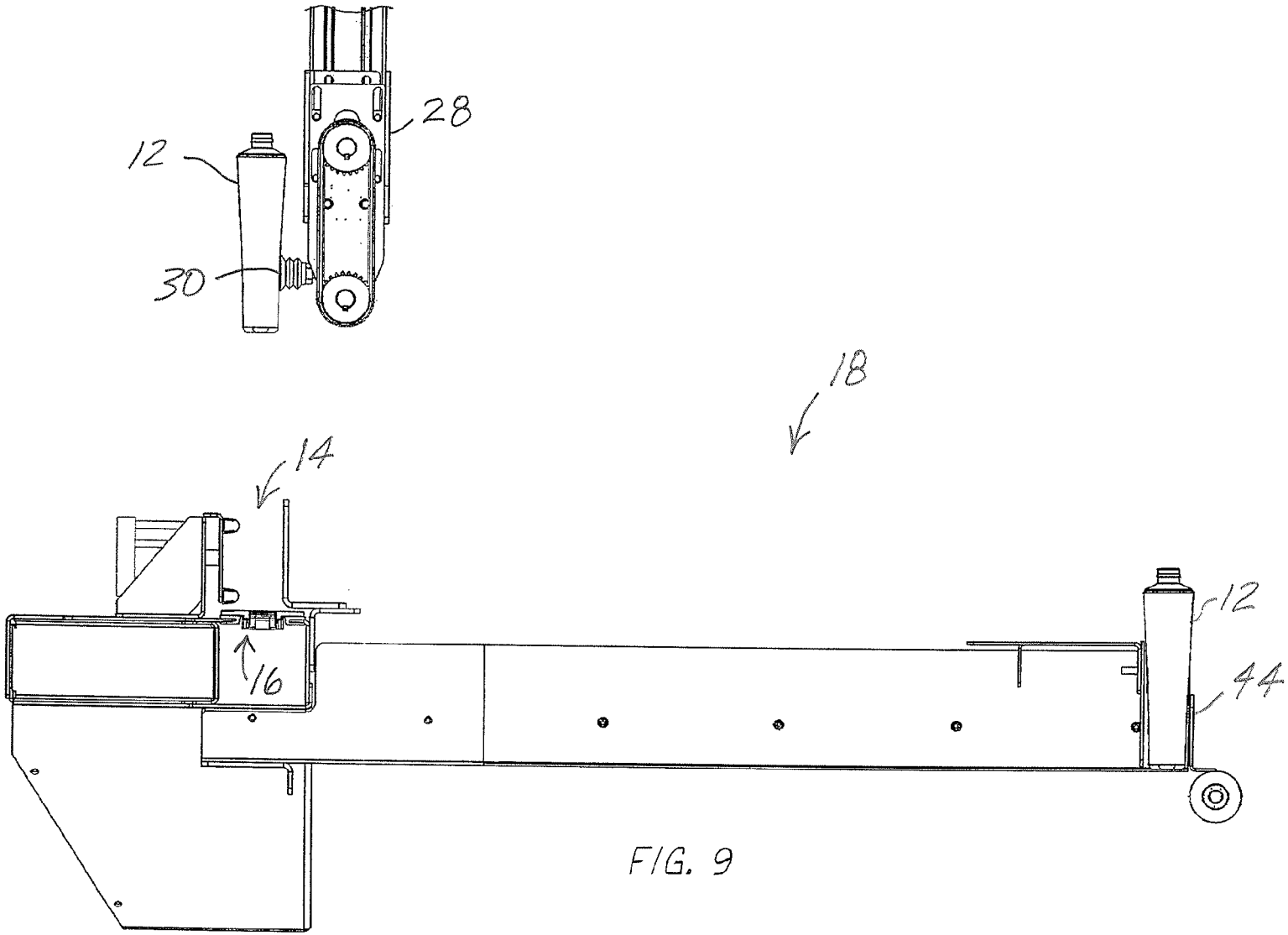
Figure 10:
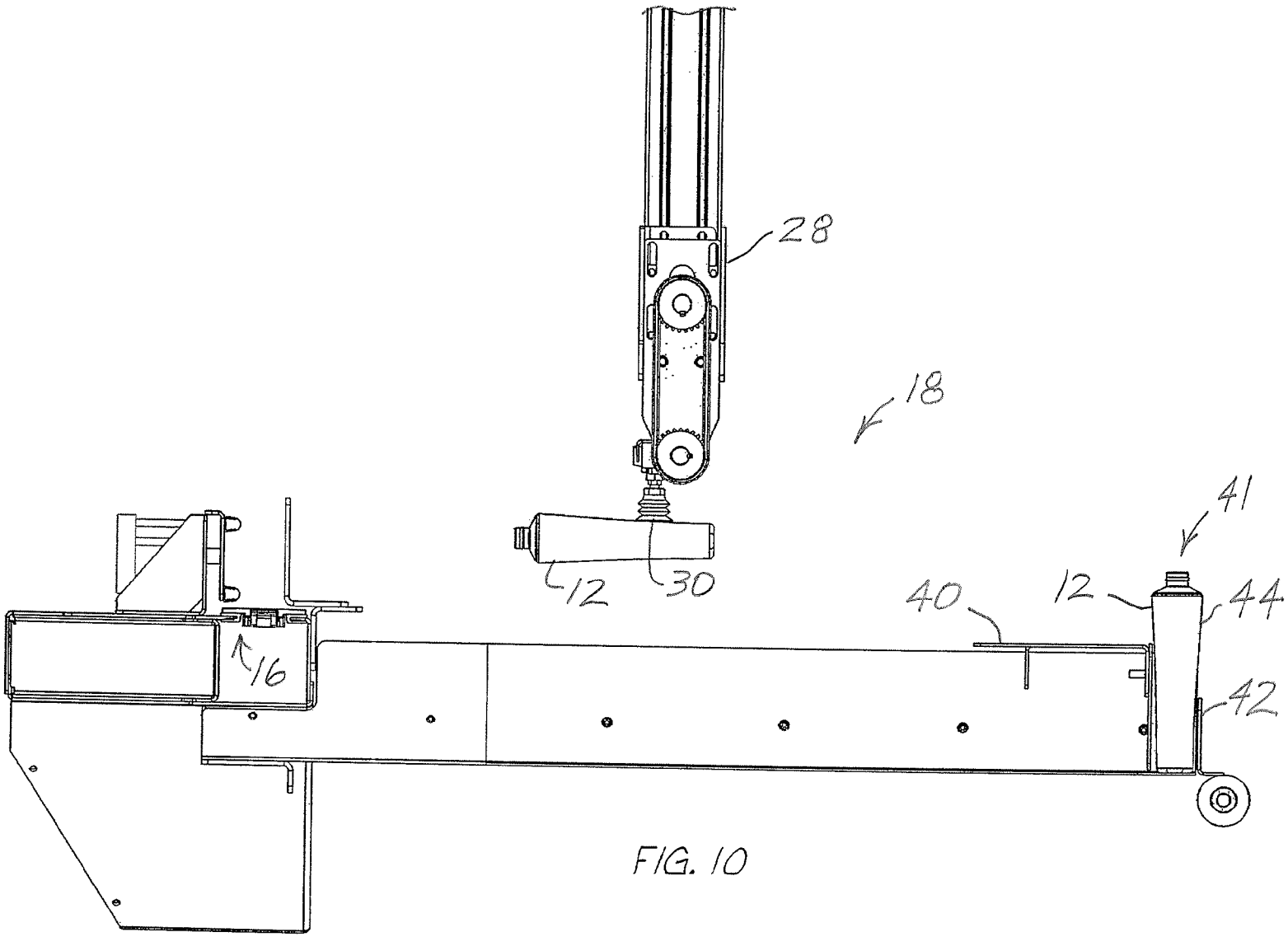
Figure 11:
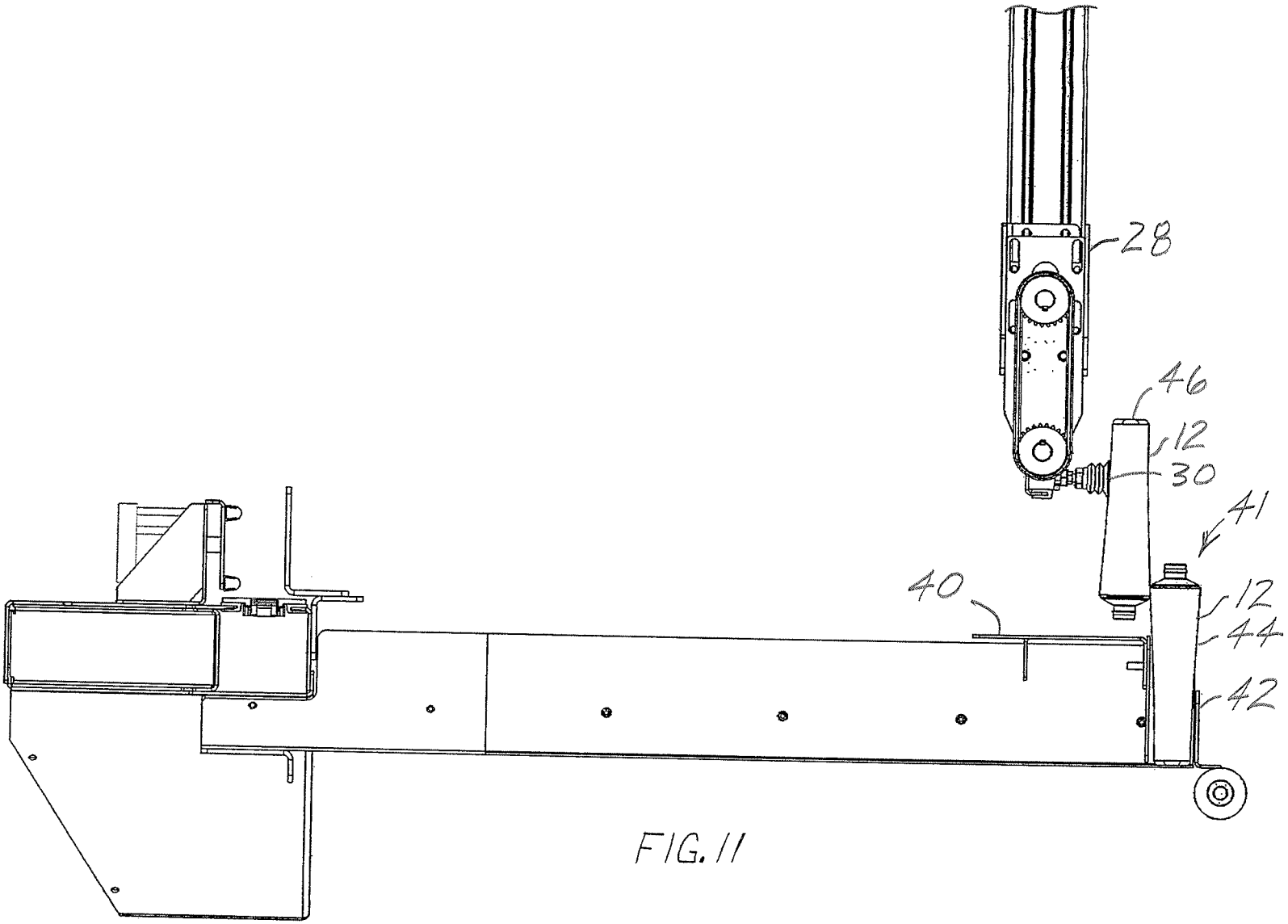
Figure 12:
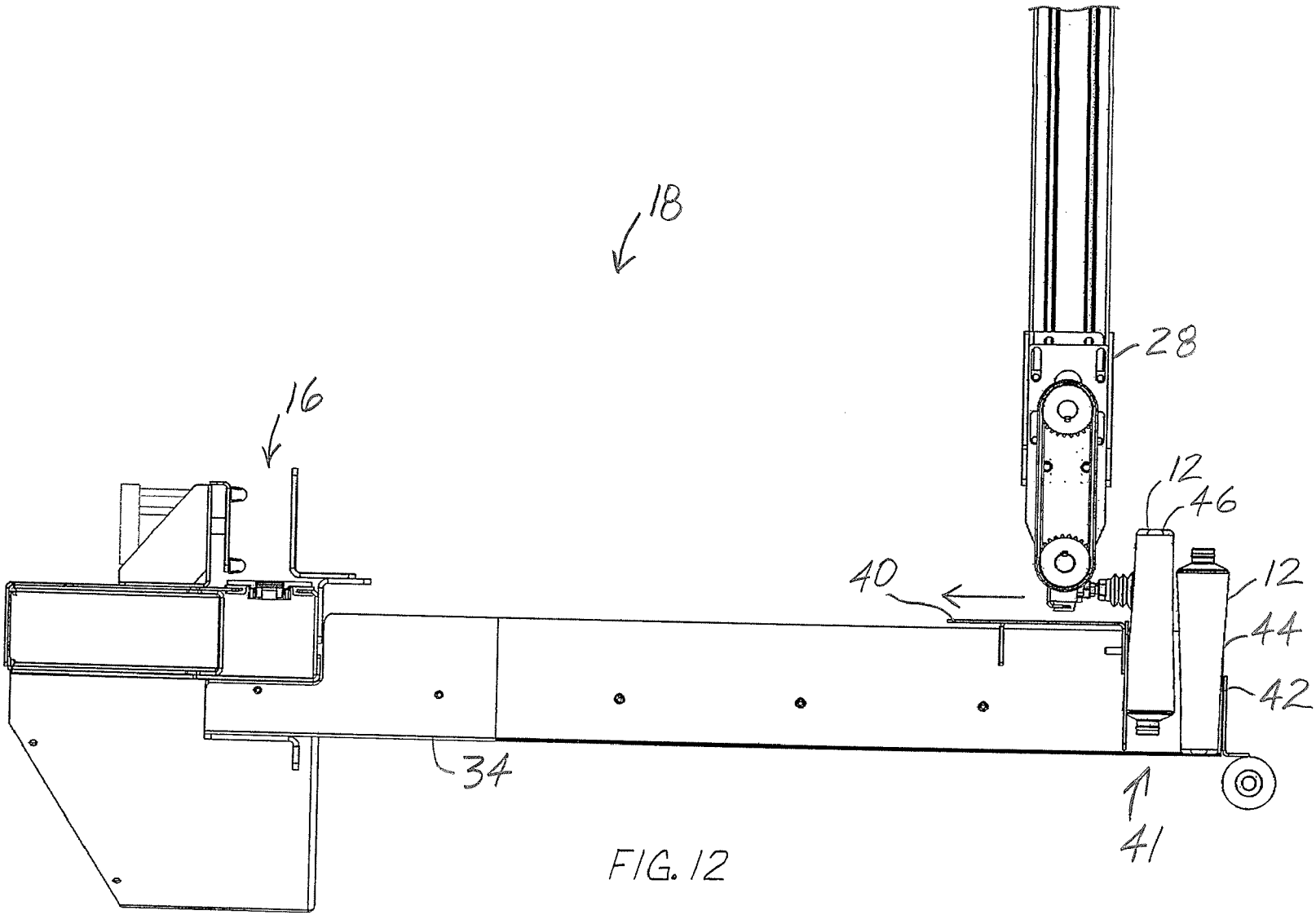

As further shown in FIGS. 9-10, robotic arm 28 changes the orientation of article row 46 as robotic arm 28 is directed to move from collection area 16 toward supporting region 41. That is, robotic arm 28 inverts article row 46 after article row 46 is raised from collection area 16 and prior to article row 46 being installed in supporting region 41. As shown in FIG. 11, a lower portion of article row 46 is brought into close proximity, or in physical contact with an upper portion of article row 44 that is already disposed and laterally supported in supporting region 41. By virtue of the close proximity/physical contact provided by article row 46, continuous peripheral lateral support is provided to article row 44, as substantially simultaneously with the lower portion of article row 46 being brought into close proximity, or in physical contact with an upper portion of article row 44, stabilizer bar 40 moves toward collection area 16. As shown in FIG. 12, inverted row 46, remaining in close proximity to article row 44, is directed into supporting region 41. It is to be understood that the other portions of the periphery of article rows 44, 46 not associated with stabilizer bar 40, i.e., in contact or close proximity with stabilizer bar 40, are supported by the remaining portions of stabilizer 32, i.e., opposed sides 36, 38 of retaining tray 34 and backstop 42.

Figure 13:
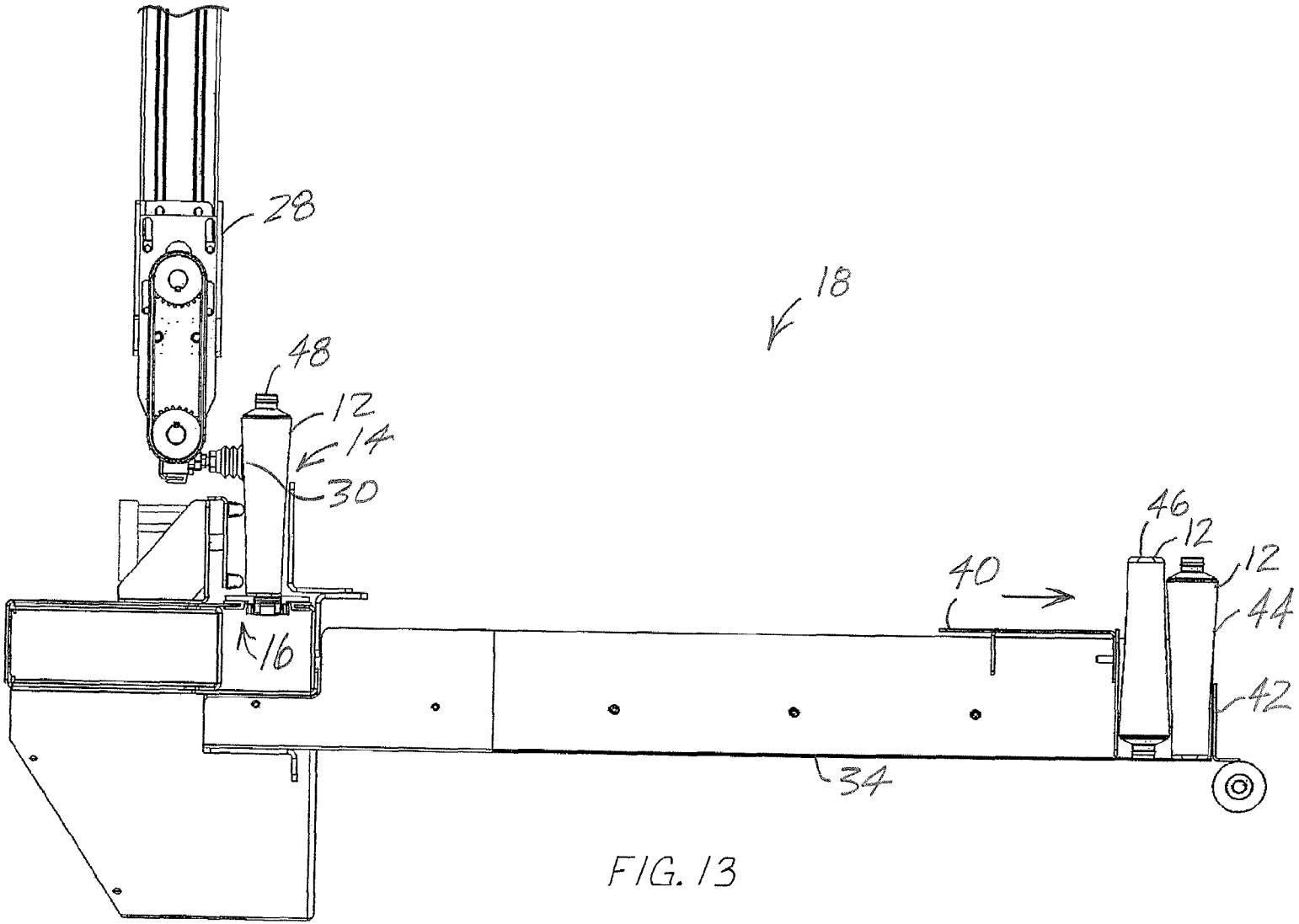
Figure 14:
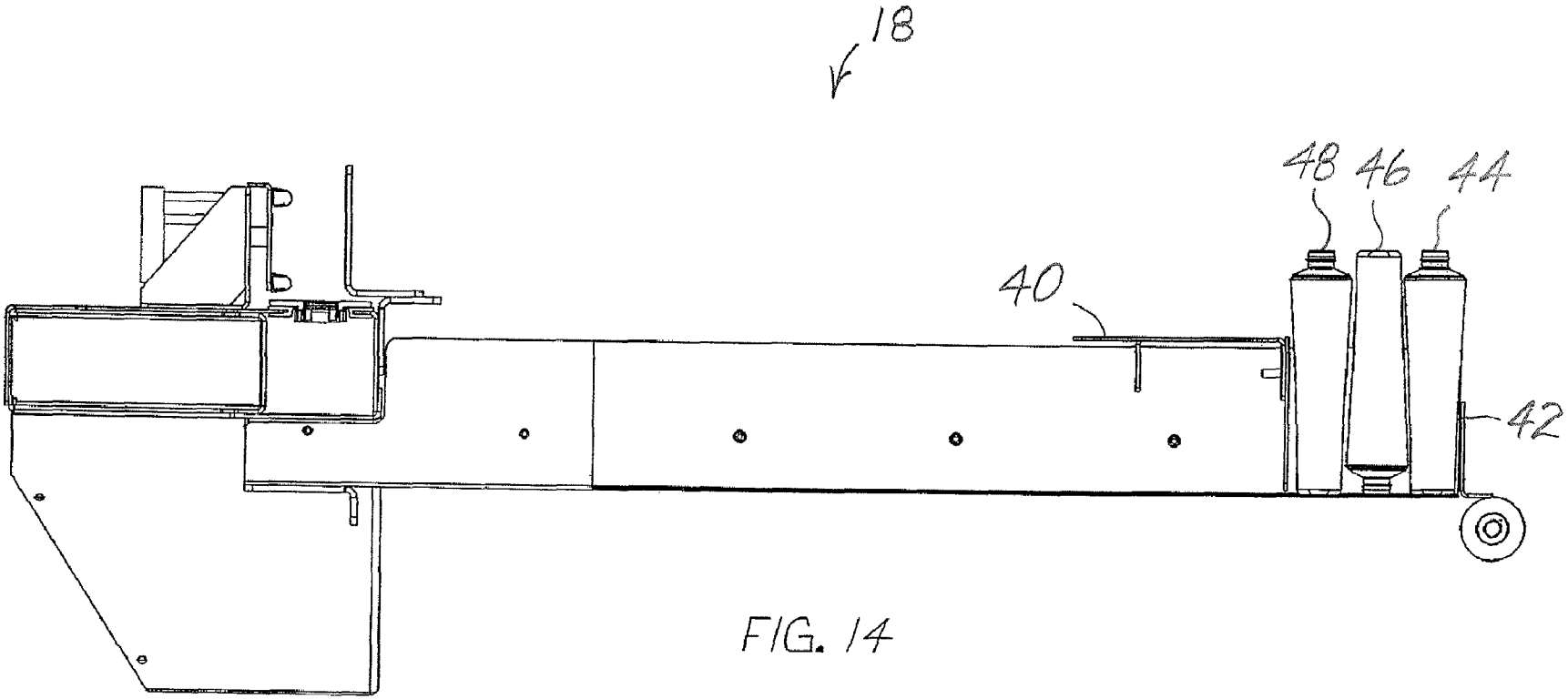

Once article row 46 is fully installed in supporting region 41 so that article rows 44, 46 are installed in supporting region 41, stabilizer bar 40 moves toward article row 46 until stabilizer bar 40 is in close proximity/physical contact with article row 46, providing lateral support to article row 46, as shown in FIG. 13. After stabilizer bar 40 is disposed in close proximity/physical contact with article row 46, end effectors 30 disengage from article row 46, and robotic arm 28 returns adjacent to collection area 16. In the embodiment as shown, the sequence of FIGS. 3-6 is repeated, resulting in the installation of article row 48 in supporting region 41 as shown in FIG. 14. Upon the completion of the installation of a sufficient number of article rows, a full article row or article layer 50 (FIG. 15) is completed.

It is to be understood that by virtue of orienting a portion of the article rows differently than the remaining article rows of an article layer, the amount of volume displaced by the resulting article layer, i.e., article layer 50 (FIG. 15) as shown, is significantly less than an article layer in which the article rows have the same orientation (see FIG. 1). Stated differently, article layer 50 has an increased volumnar density. In addition to the increased volumnar density, by virtue of the enhanced degree of proximity between article rows, the resulting article layer 50 is less apt to shift position, and is thus, more stable for transport.

It is to be understood that while alternating article rows are inverted in one embodiment, to construct article layer 50, it may be desirable to use a different orientation sequence. That is, several adjacent article rows may have the same orientation, inverted or non-inverted. In addition, the term "different orientation" is not limited to mean inverted versus non-inverted, as there may be other possible orientations, depending upon the geometry of the article that is to be packaged.

Figure 24:
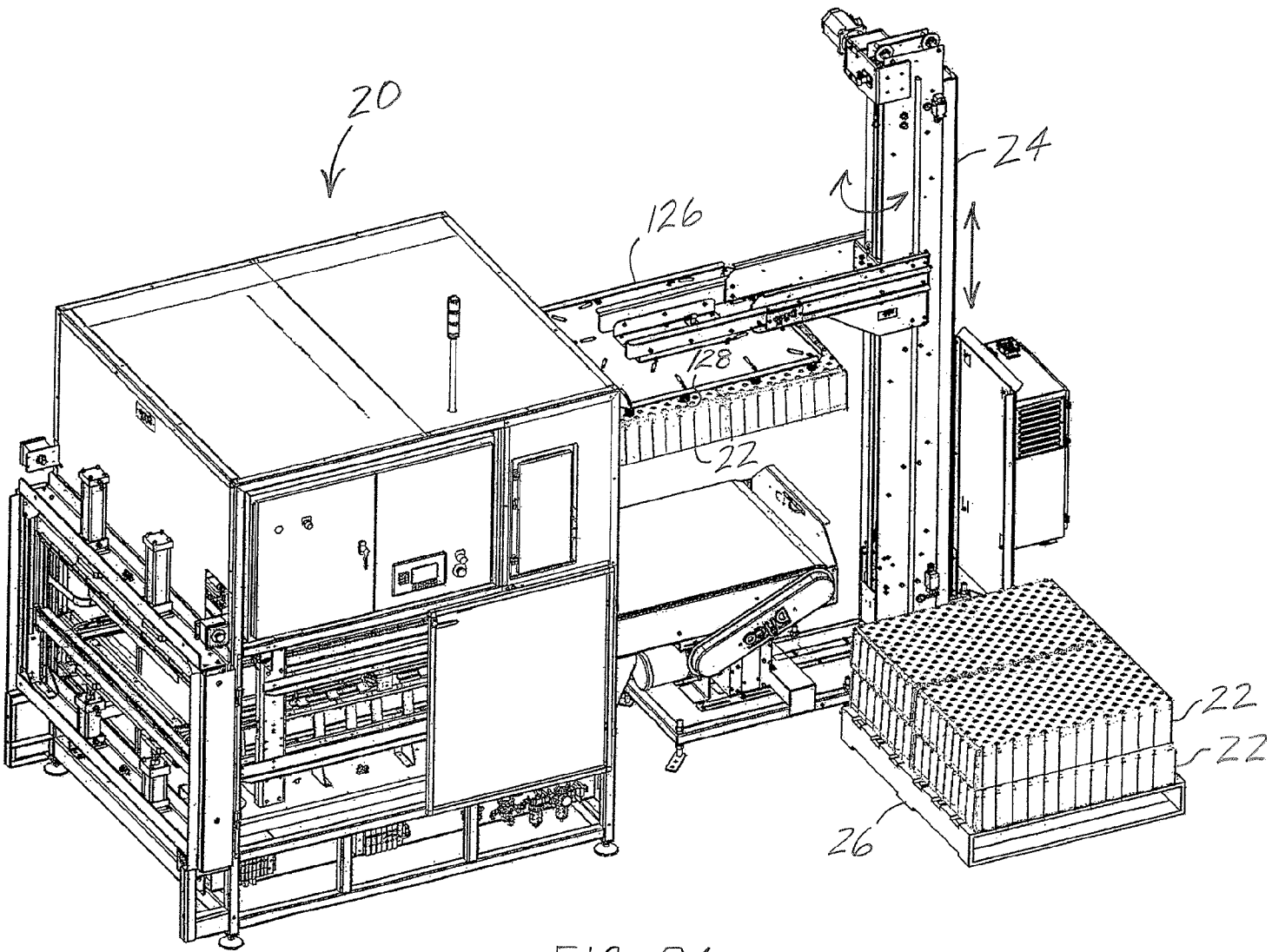
FIG. 24 shows a perspective view of an embodiment of a bagging area and unloading area of the present disclosure.

As shown in FIGS. 15-18, the completed article layer 50 is then directed from consolidation area 18 to bagging area 20 in order to apply a layer of material over the article layer, surrounding the article layer, ultimately resulting in a bagged array or enclosed article layer 22 (FIG. 24). The terms bagged array, enclosed array, substantially enclosed array, enclosed layer or combination thereof may be used interchangeably. As further shown, material layers 52 and 54 provided by separate material layer sources (not shown) are used to substantially enclose article layer 50. Material layer 52 is applied to the upper portion (e.g., half) of article layer 50, and material layer 54 is applied to the lower portion (e.g., half) of article layer 50. Material 52 and material 54 form a junction 84 (FIG. 15) as a result of the bagging operation of the previous article layer.

Figure 16:
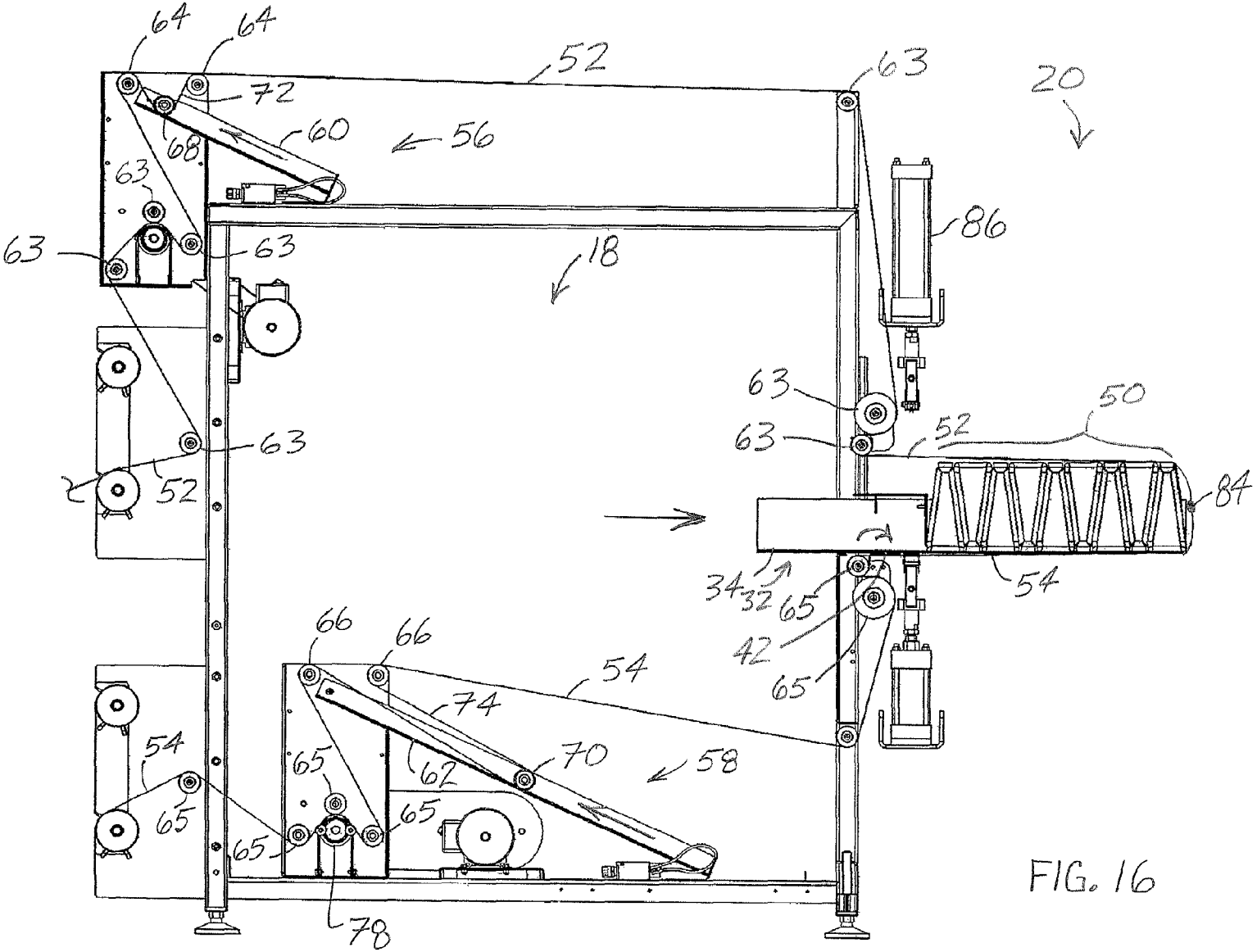
FIGS. 16-18 show sequential steps in the operation of the consolidation/bagging areas of the present disclosure.

As shown in FIG. 16, stabilizer 32, is directed into bagging area 20. In one embodiment, junction 84 is disposed between backstop 42 and article layer 50. By virtue of this arrangement, in response to movement of stabilizer 32 toward bagging area 20, backstop 42 rotates out of the way, permitting the stabilizer to pass over the backstop. Also in response to movement of stabilizer 32 toward bagging area 20, material layer 52 is applied over the upper portion of article layer 50 and material layer 54 is applied over the lower surface of the retaining tray 34, corresponding to the lower portion of the article layer, with material layers 50, 54 substantially forming a tube of material. Due to the maintenance of a tensile force in material layers 52, 54, junction 84 of the material layers 52, 54 continue to provide lateral support to the end of article layer 50 facing away from consolidation area 18, formerly supported by backstop 42. Therefore, lateral support along the outer periphery of article layer 50 is maintained as the article layer passes from consolidation area 18 to bagging area 20.

Referring back to FIG. 15, tensioning devices 56, 58 are employed to controllably feed respective material layers 52, 54 over article layer 50 with a sufficient, but not excessive amount of tension or tensile force. Material layer 52 from the material layer source (not shown) engages a number of respective rollers 63, 64 prior to terminating at junction 84. Similarly, material layer 54 from the material layer source (not shown) engages a number of respective rollers 65, 66 prior to terminating at junction 84. Tensioning device 56 includes a ramp 60 supporting an axle 68, which engages a loop 72 of material formed from material layer 52 disposed between rollers 64. In a like manner, tensioning device 58 includes a ramp 62 supporting an axle 70 which engages a loop 74 of material formed from material layer 54 disposed between rollers 66. In one embodiment, loops 72, 74 are sufficiently sized to dispense a corresponding length of respective material layers 52, 54 to enclose the lengthwise periphery of article layer 50 (e.g., FIG. 17). In operation, in response to stabilizer 32 being directed toward bagging area 20, the size of each loop 72, 74 of respective material layer 52, 54 is reduced, as the material layers 52, 54 are being applied to the upper and lower portions of the article layer 50 sufficient to surround the article layer.

The geometry, i.e., length and slope, of the ramps 60, 62 are determined by a number of factors, including the number and locations of respective rollers 63, 64, 65, 66 for a given weight of axle 68, 70, as well as available room in the article packaging system. In response to stabilizer 32 being directed from consolidation area 18 to bagging area 20, a predetermined length of material layers 52, 54 is applied to the respective upper and lower portions of article layer 50 from corresponding loops 72, 74 of material layers 52, 54. FIGS. 15 and 16 show loops 72, 74 both prior to (FIG. 15) and after material layers 52, 54 have been provided to enclose article layer 50, as evidenced by movement of axle 68 toward rollers 64 and movement of axle 70 toward rollers 66 (see FIG. 16). Tensioning devices 56, 58 provide a tensile force that is substantially evenly distributed along the lengths of respective axles 68, 70 for each of material layer 52, 54. This tensile force permits even application of material layer 52, 54 over article layer 50, and is generated by the force of gravity associated with urging axles 68, 70 to roll downward along respective ramps 60, 62.

Figure 17:
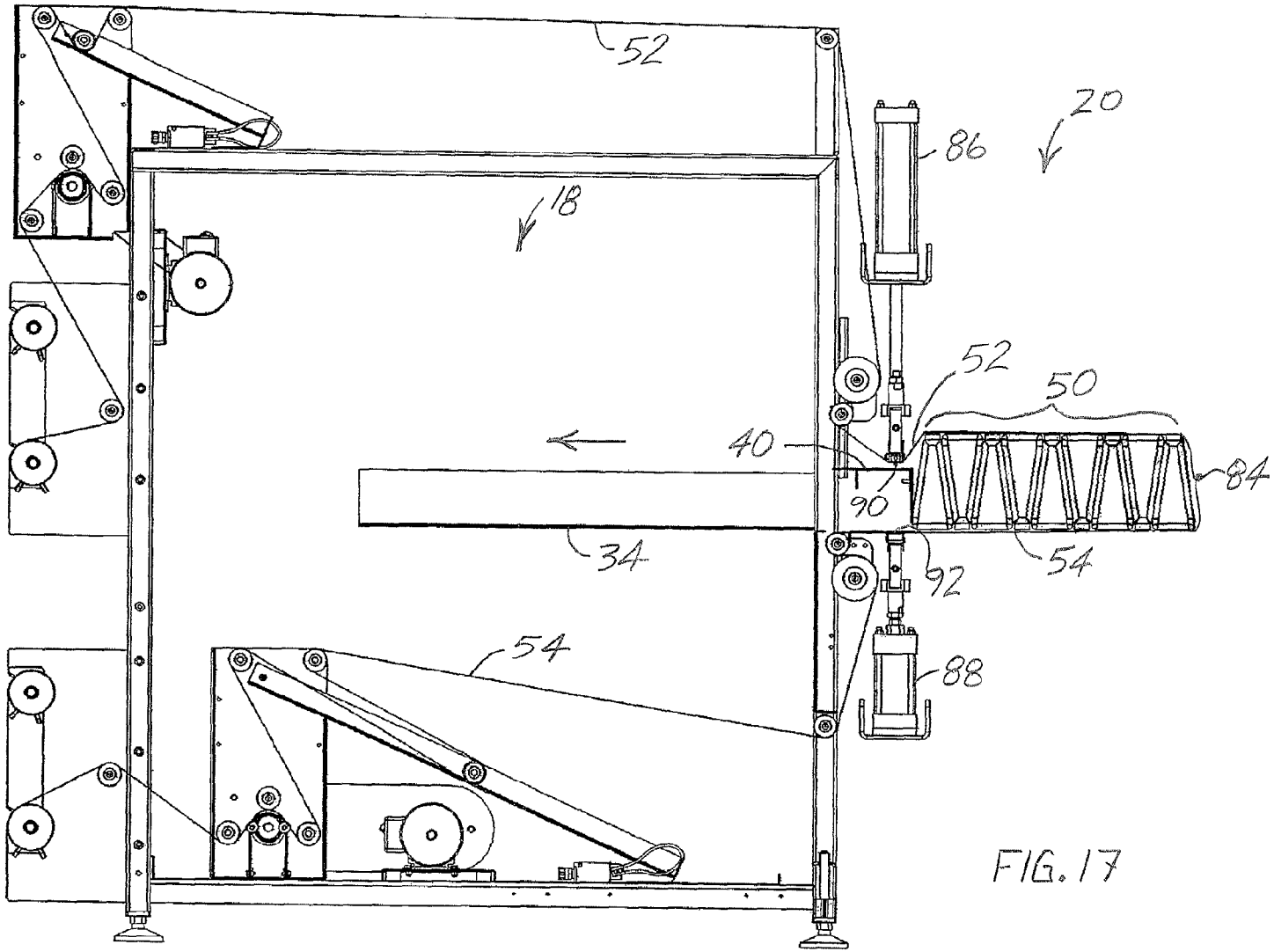

After the combined stabilizer 32 and article layer 50 have been initially directed into bagging area 20 (FIG. 16), as shown in FIG. 17, retaining tray 34 is retracted to move to its original position in consolidation area 18. However, just prior to or substantially simultaneously with the retraction of retaining tray 34, actuator 86 urges end 90 into directed movement toward stabilizer bar 40. This movement of end 90 contacts and downwardly deflects, at least along a region adjacent to end 90, the position of material layer 52 with respect to the upper portion of article layer 50 facing consolidation area 18. The downwardly deflected portion of material layer 52 in contact with article layer 50 substantially prevents tipping of article layer 50 along the resulting contact area, providing lateral support along the upper portion of article layer 50. As a result of the retraction of retaining tray 34, the lower portion of article layer 50 now rests directly on material layer 54.

Figure 18:
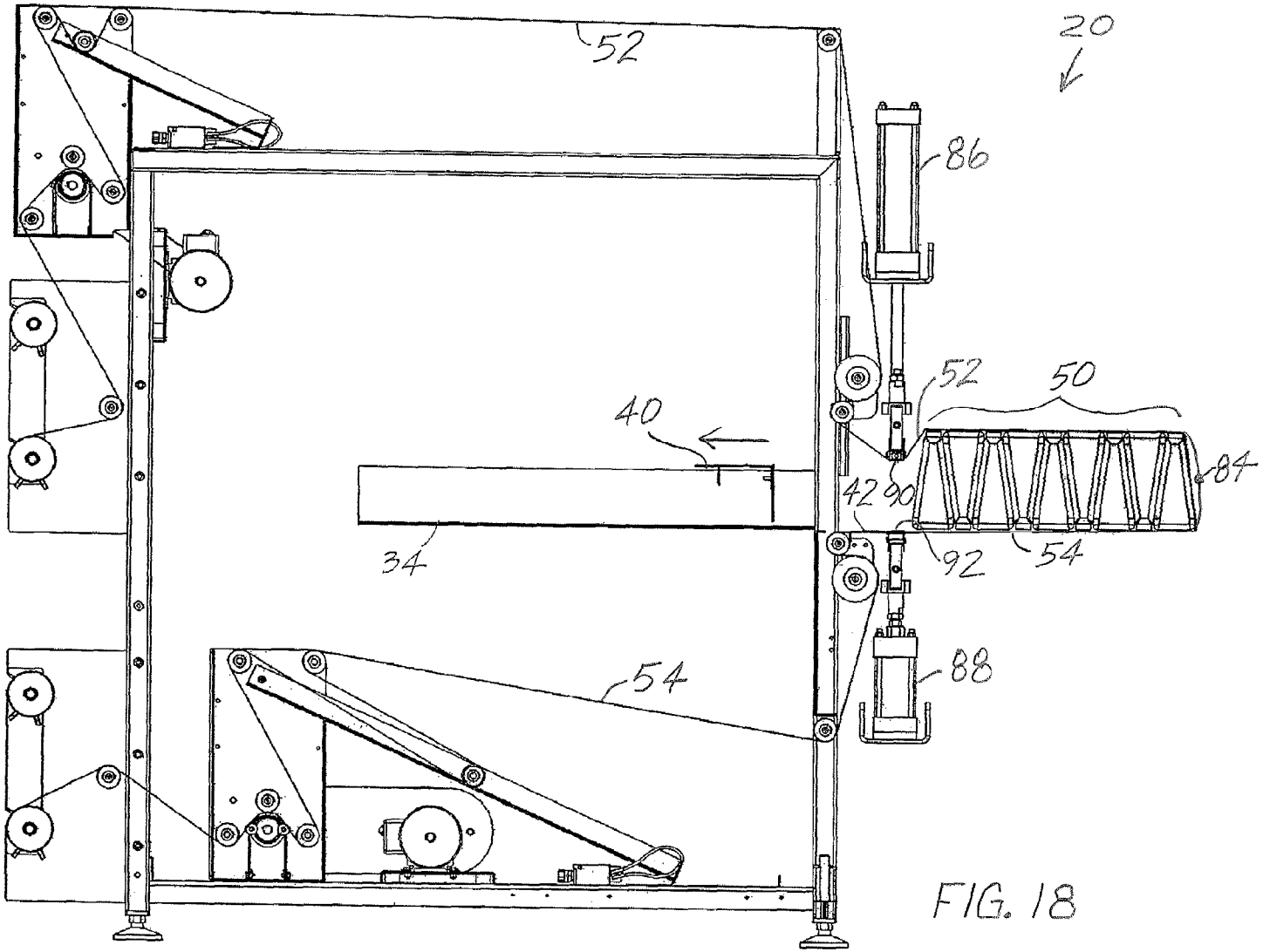

As shown in FIG. 18, once retaining tray 34 has been retracted, stabilizer bar 40 is then retracted to move to its original position in consolidation area 18. As a result of the downwardly deflected portion of material layer 52 in response to the previously described downward movement of end 90, material layers 52, 54 joined along junction 84 facing bagging area 20 substantially enclose article layer 50 sufficient to provide lateral support along the periphery of material layers 52, 54. Shortly thereafter, end 90 and anvil 92 are directed into contact with each other by respective actuators 86, 88. End 90 has a heated element therein, that results in the formation of a new junction 84 between material layers 52, 54, which junction 84 acting to achieve three ends: both seal article layer 50 and sever article layer 50 from material layers 52, 54 and forming the basis for bagged or enclosed article array or layer 22 (FIG. 24), as well as establishing a new junction 84 between ends of material layers 52, 54 opposite severed article layer 50. The junction 84 formed opposite severed article layer 50 becomes the new end of the bag end used with the next article layer to be constructed, as shown in FIG. 15.

Once the tube of material enclosing article layer 50 is formed, i.e., the ends of material layers 52, 54 are joined together to define the tube, with the tube subsequently severed due to formation of junction 84 as discussed above, material loops 72, 74 must be replenished. To achieve replenishment of material loops 72, 74, motor 80 (FIG. 15) directs drive roller 76 into rotation to draw material layer 52 from the material layer source to enlarge loop 72 associated with axle 68. As loop 72 is enlarged, axle 68 proceeds downwardly along ramp 60 toward a proximity switch 94 until axle 68 actuates proximity switch 94. Upon actuation of proximity switch 94, operation of motor 80 is discontinued. Similarly, motor 82 (FIG. 15) directs drive roller 78 into rotation to draw material layer 54 from the material layer source to enlarge loop 74 associated with axle 70. As loop 74 is enlarged, axle 70 proceeds downwardly along ramp 62 toward a proximity switch 96 until axle 70 actuates proximity switch 96. Upon actuation of proximity switch 96, operation of motor 82 is discontinued. In other words, motors 80, 82 replenish respective loops 72, 74 in preparation of enclosing the next article layer that is to be constructed by the article packaging system.

In addition, once the tube of material enclosing article layer 50 is formed, the ends of tube material disposed transverse to junctions 84 must be closed to form bagged article array or enclosed layer 22 (FIG. 24) to ensure the articles in article layer 50 remain substantially in position, i.e., substantially maintain the arrangement of articles of article layer 50. As shown in FIGS. 19-23, which is a cross-section of bagging area 20 taken along line 19-19 of FIG. 2, partially enclosed article layer 50 includes material layer 52 extending to opposed flaps 53 and material layer 54 extending to opposed flaps 55. To enclose article layer 50, adjacent flaps 53, 55 are joined together. However, in one embodiment, prior to the corresponding flaps 53, 55 being joined together, articles 12 of article layer 50 are maintained in position in bagging area 20 by downward extending flanges 130 (see FIG. 20) which are disposed in close proximity to opposed upper portions of corresponding outermost disposed rows 49 of article layer 50. In addition, if required, an anvil 108 associated with an actuator 104 extends sufficiently vertically to form a raised region in material layer 54 with respect to the lower level associated with material layer 54 disposed beneath article layer 50, thereby acting to provide a lateral force along the lower portion of rows 49 to maintain the arrangement of the articles of article layer 50. It is appreciated that the opposed flanges 130 may be adjusted to receive both articles and the resulting article layers of different constructions, e.g., size and arrangements. As shown, rows 49 are transverse to article rows 44, 46, 48 (FIG. 8) formed in consolidation area 18. However, it is to be understood that flanges 130 and anvil 108 or other constructions may be used that are not transverse to article rows 44, 46, 48, or even linear, if desired.

Figure 19:
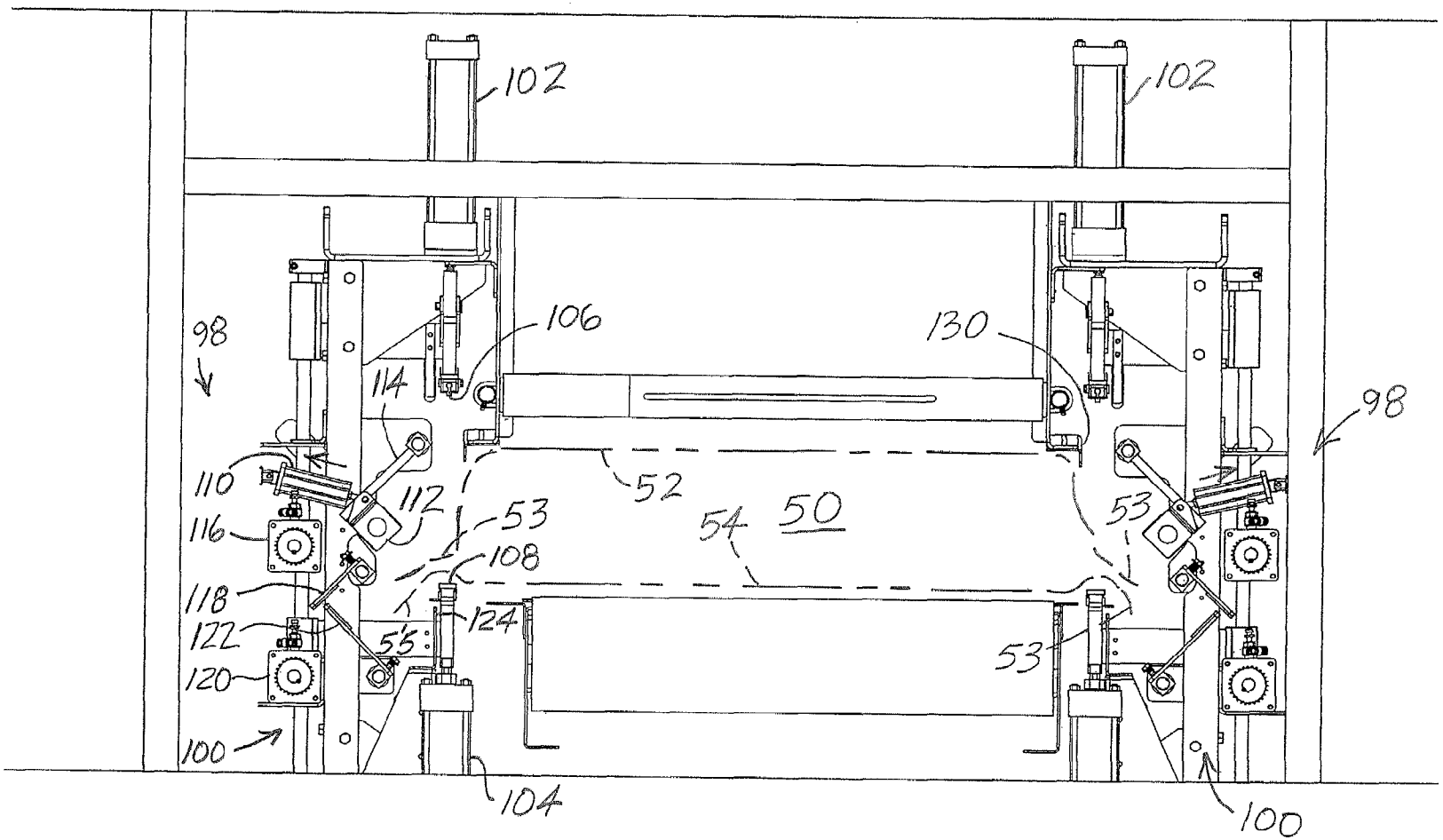
FIG. 19 is a cross-section taken along line 19-19 of FIG. 2 of an embodiment of a bagging area of the present disclosure.

As further shown in FIG. 19, opposed upper flap gripper assemblies 98 are configured to grip each flap 53, and opposed lower flap gripper assemblies 100 are configured to grip each flap 55. In one embodiment, upper flap gripper assembly 98 includes an actuator 110 that is pivotably connected to a gripper head 112 which is likewise pivotably connected to a shaft 114. That is, in response to actuator 110 directing gripper head 112 into movement, the end of gripper head 112 also moves along an arc defined by pivoting shaft 114. Gripper head 112 includes a capability to draw flap 53 into contact with gripper head 112, such as by a pneumatic vacuum, although other techniques, such as adhesives may be used.

Figure 20:
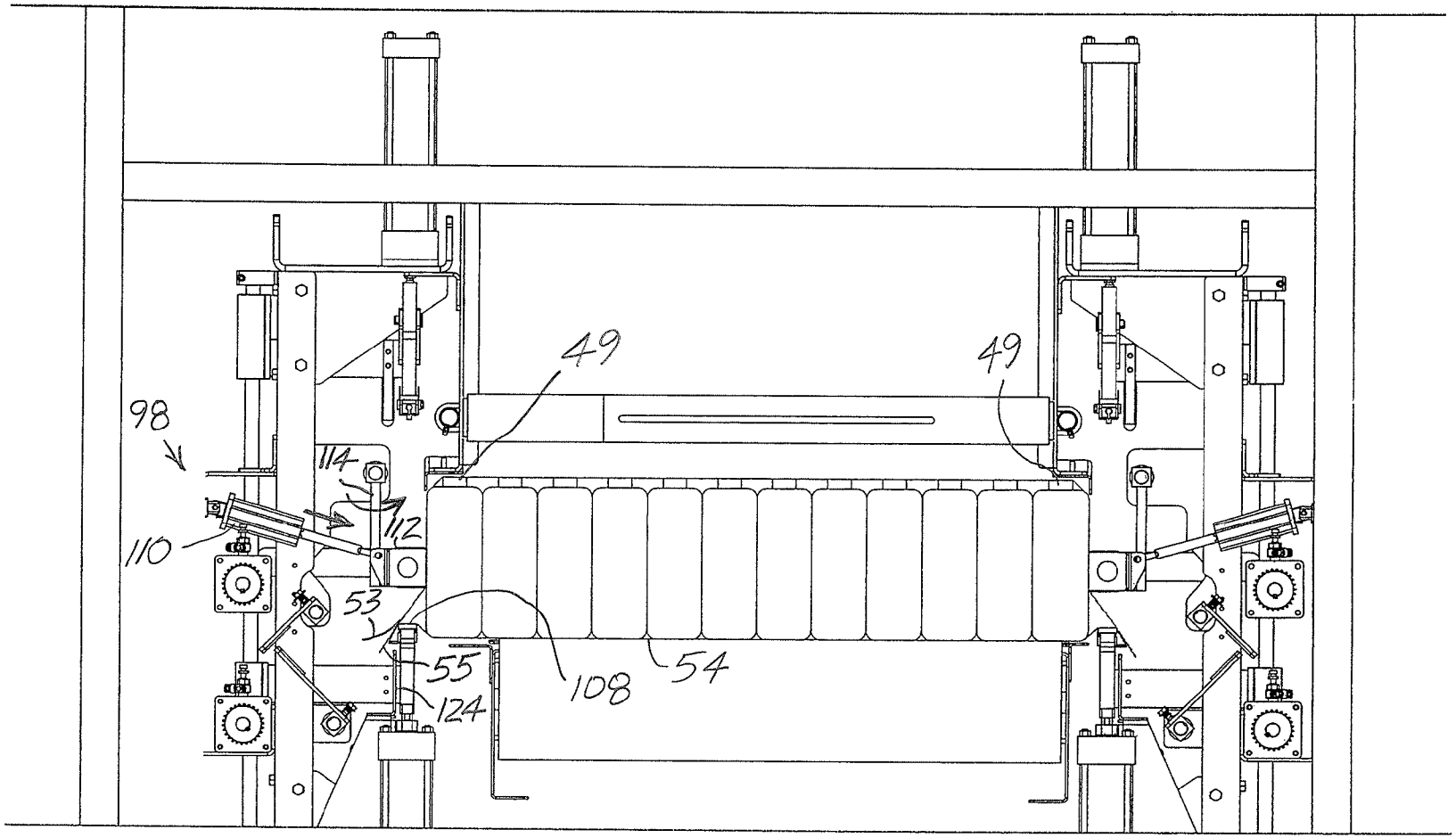
FIGS. 20-23 show sequential steps in the operation of the lateral support system of an embodiment of the bagging area of FIG. 19 of the present disclosure.

As shown in FIG. 20, movement of actuators 110, i.e., extension of the actuators, in combination with pivoting shafts 114 result in gripper heads 112 defining an arcuate path toward outer rows 49 of article layer 50 until gripper heads contact or are brought into close proximity with corresponding flaps 53. By force of gravity, flaps 55 extend outwardly and downward from the lower portions of rows 49 of article layer 50. In an alternate embodiment, additional techniques, such as pneumatic vacuum may be used to draw flaps 55 away from article layer 50 to more easily permit flaps 55 to be accessed.

Figure 21:
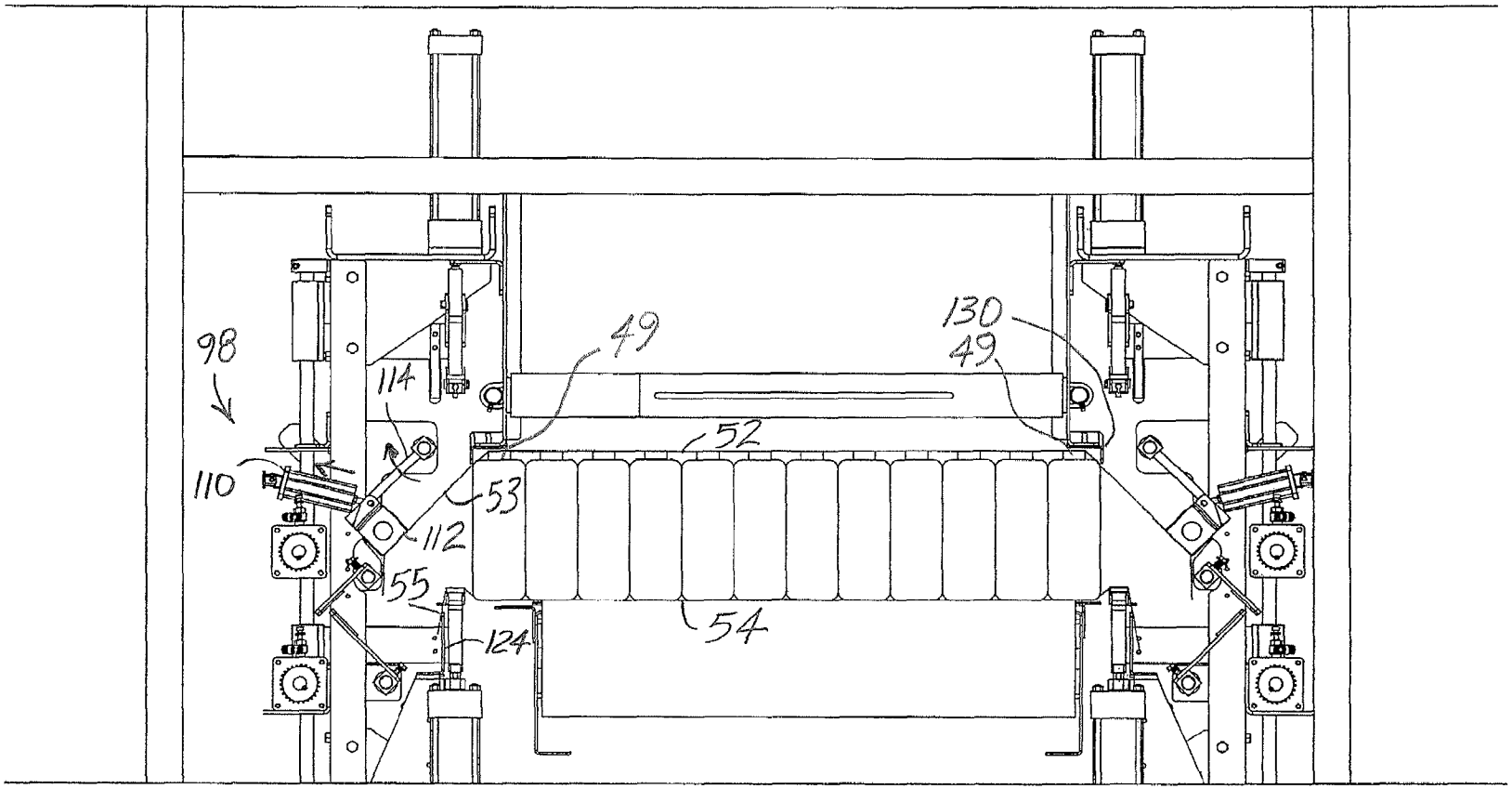

As shown in FIG. 21, once gripper heads 112 have been brought into contact or at least in close proximity to flaps 53, actuators 110 are actuated in a reverse direction than shown in FIG. 20, i.e., retracted, resulting in gripper heads 112, and corresponding flaps 53 secured to gripper heads 110, moving away from rows 49 of article layer 50. In addition, flaps 55, whether by force of gravity alone, or with assistance from additional features, such as pneumatic vacuum, extend outwardly and downwardly from the lower portion of article rows 49 of article layer 50.

Figure 22:
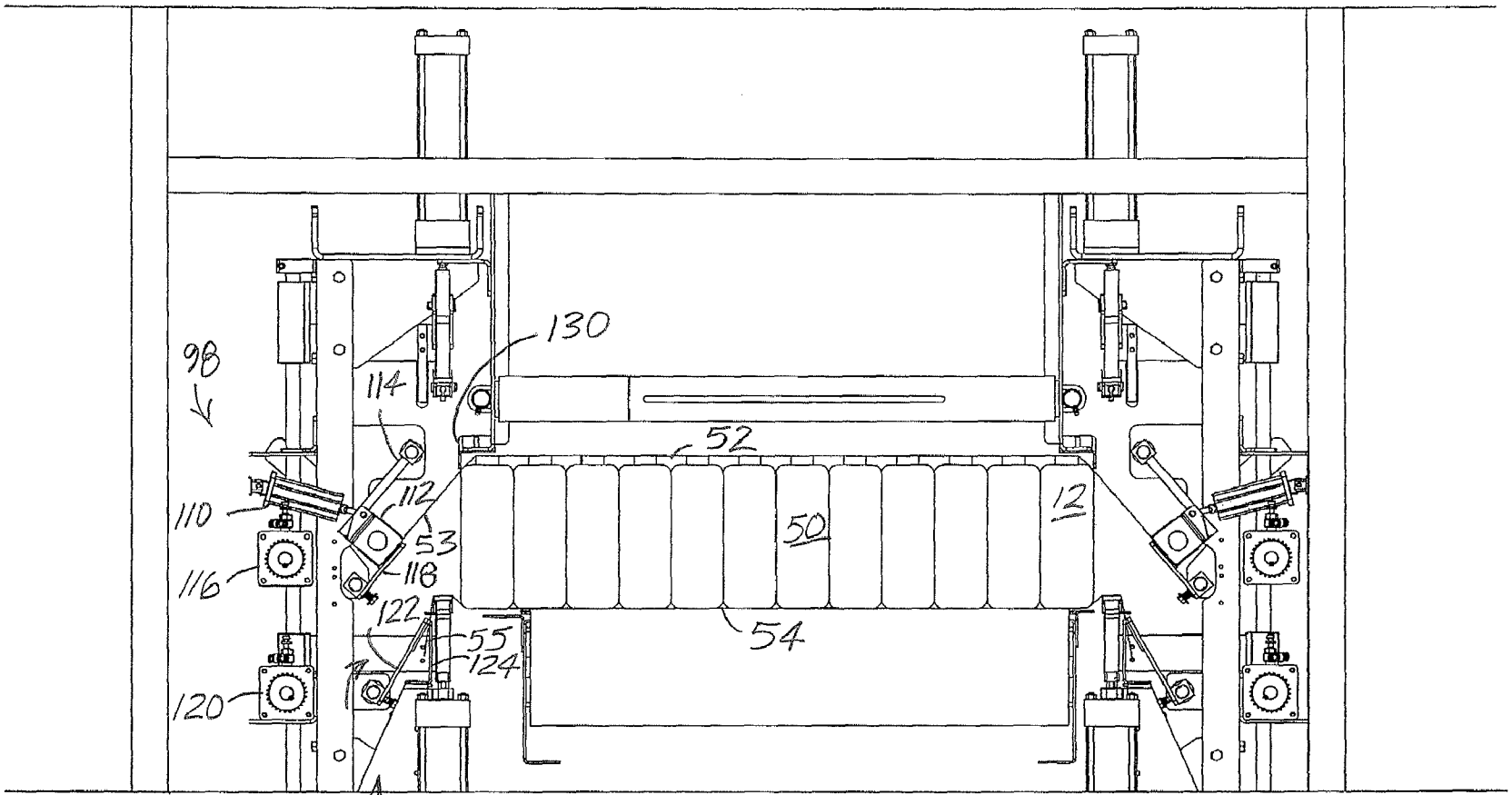
Figure 23:
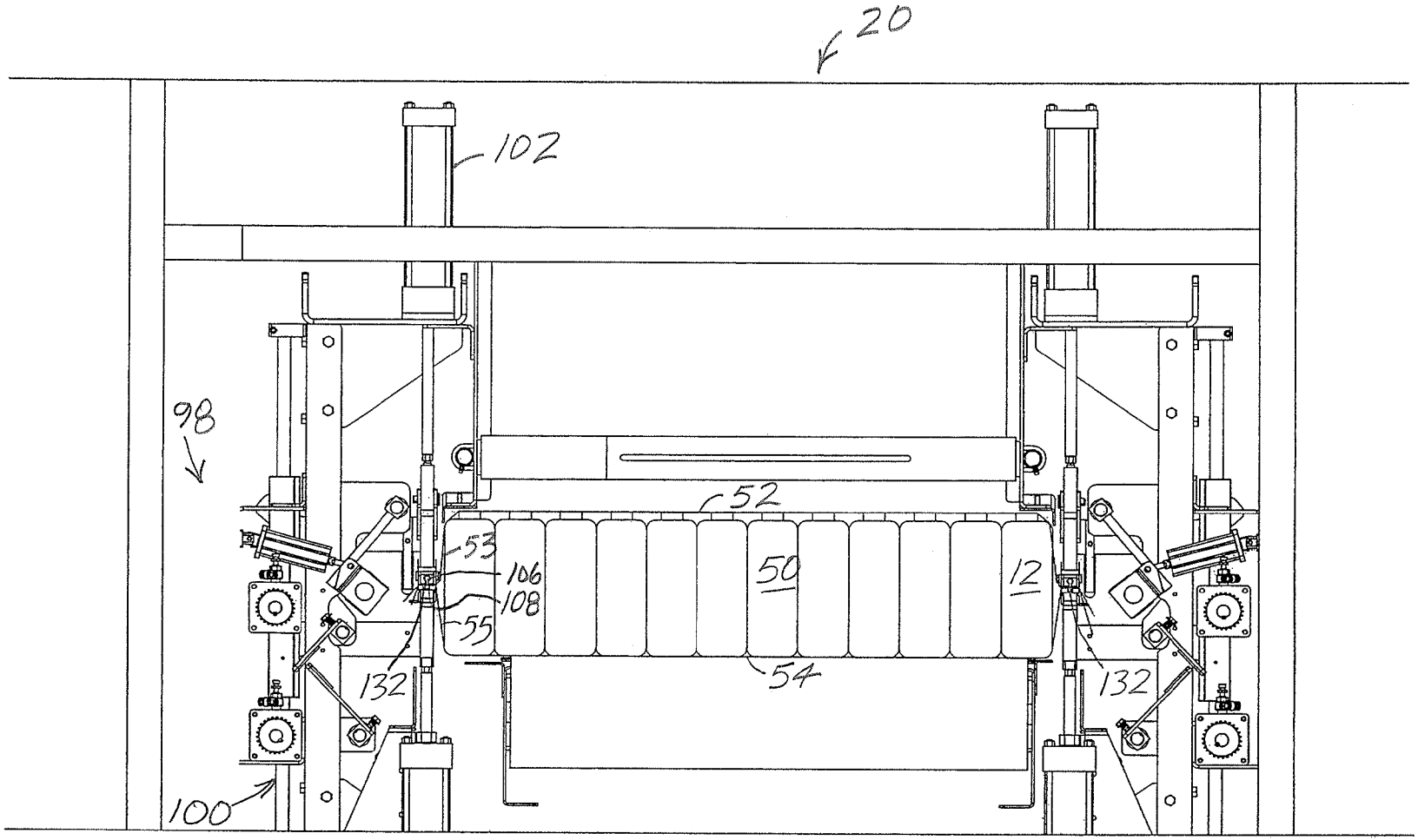

As shown in FIG. 22, once actuators 110 are sufficiently retracted, motors 116 urge opposed grippers 118 to rotate, capturing corresponding flaps 53 between gripper head 112 and gripper 118. Similarly, motors 120 urge opposed grippers 122 to actuate, capturing corresponding flaps 55 between gripper 122 and adjacent structure, such as angle 124. Once flaps 53, 55 are captured, as shown in FIG. 23, corresponding ends 106 having heated elements and anvils 108 are directed into contact by actuators 102, 104 to form junctions 132 in the flaps of material layers 52, 54, similar to the formation of junctions 84 as previously discussed. Upon formation of junctions 132, article layer 50 is transformed into bagged article array or enclosed article layer 22.

It is appreciated that upon the article layer 50 moving from consolidation area 18 to bagging area 20, once stabilizer 32 returns to consolidation area 18, many of the operations discussed herein may be performed simultaneously to optimize performance of the article packaging system.

It is also to be understood that while articles of the article layer, as shown in one embodiment, are arranged in aligned rows that are substantially parallel to each other and are also aligned in a transverse direction, article geometries may permit an arrangement in which articles in the article rows are non-aligned, i.e., staggered.

As shown in FIG. 24, once enclosed article layer 22 is formed, it is moved from bagging area 20 to unloading area 21. A stacking device 24, having a gripper head 126 and grippers 128, may transport enclosed article layer 22 onto a pallet 26. In one embodiment, stacking device 24 may locate article layers 22 to pallets 26 located at multiple positions, such as shown in FIG. 2. It is appreciated that slip sheets and end caps (not shown) may be used to palletize the article layers 22.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for packaging articles, the steps comprising:

arranging a plurality of articles having a substantially non-uniform geometry within a first collection area;

transporting the plurality of articles from the first collection area to a consolidation area for constructing an article layer;

laterally supporting the periphery of the plurality of articles arranged within the consolidation area to substantially prevent tipping of the plurality of articles;

arranging a subsequent plurality of articles within the first collection area;

transporting the subsequent plurality of articles from the first collection area to the consolidation area adjacent the plurality of arranged articles, the periphery of the plurality of arranged articles being continuously laterally supported while the subsequent plurality of articles is being arranged, the orientation of the subsequent plurality of articles being different than the orientation of the plurality of arranged articles, and upon the arrangement of the subsequent plurality of articles, the periphery of the plurality of arranged and subsequently arranged articles being laterally supported;

repeating the arranging and transporting steps for subsequent plurality of articles until the article layer is constructed; and substantially enclosing the article layer in a layer of resilient material substantially maintaining the arrangement of the article layer.

2. The method of claim 1 wherein the difference of orientation between the subsequent plurality of articles and the plurality of arranged articles results in an increased volumnar density of the article layer.

3. The method of claim 1 including the step of arranging subsequent enclosed article layers until a full pallet of enclosed article layers is constructed.

4. The method of claim 3 further including the step of placing a slip sheet between article layers.

5. The method of claim 4 further including the step of placing a top sheet or a tray over the top article layer.

6. The method of claim 1 wherein in the transporting step, the subsequent plurality of articles is inverted with respect to the orientation of the plurality of arranged articles.

7. The method of claim 1 wherein the step of laterally supporting the periphery of the plurality of articles is achieved by a stabilizer.

8. The method of claim 1 wherein in the step of transporting the subsequent plurality of articles, a portion of the periphery of the plurality of arranged articles is laterally supported by the subsequent plurality of articles while the subsequent plurality of articles is being arranged.

9. The method of claim 7 wherein in the step of transporting the subsequent plurality of articles, the periphery of the plurality of arranged and subsequently arranged articles is laterally supported by a stabilizer.

10. The method of claim 9 wherein the step of transporting the subsequent plurality of articles includes arranging the subsequent plurality of articles in a row that is substantially parallel to the row formed by the plurality of arranged articles.

11. The method of claim 9 wherein the step of transporting the subsequent plurality of articles includes arranging the subsequent plurality of articles in a row that is substantially aligned with the row formed by the plurality of arranged articles.

12. The method of claim 1 wherein the step of transporting the plurality of articles includes arranging the plurality of articles in a row.

13. A system for packaging articles comprising:

a first collection area for receiving and arranging a plurality of articles having a substantially non-uniform geometry;

a transport device;

a consolidation area for constructing an article layer, each article layer constructed from the plurality of arranged articles transported from the first collection area by the transport device, the consolidation area including a stabilizer providing substantially continuous lateral support along the periphery of arranged articles of the article layer being constructed to substantially prevent tipping of the plurality of arranged articles;

an area for substantially enclosing the article layer in a layer of material;

wherein a portion of the arranged articles transported by the transport device is oriented differently from the other arranged articles; and wherein the article enclosing area includes a material layer source in association with a material layer tensioning device.

14. The system of claim 13 wherein the periphery of the article layer is continuously laterally supported while the article layer is being enclosed in the material layer to substantially maintain the arrangement of the enclosed article layer.

15. The system of claim 13 wherein the material layer tensioning device is gravity driven.

16. The system of claim 15 wherein the material layer tensioning device includes an axle disposed on a ramp and in a looped engagement with the material layer, wherein the axle is configured and disposed to traverse the ramp by force of gravity to increase the size of the loop sufficient for enclosing a portion of the article layer with the material layer.

17. The system of claim 16 includes a proximity switch disposed at a predetermined position along ramp for indicating proper operation of the material layer tensioning device.

18. The system of claim 16 comprising a pair of material layer tensioning devices, each material layer tensioning device associated with a material layer source, one material layer source associated with enclosing an upper portion of the article layer, the other material layer source associated with enclosing a lower portion of the article layer.

* * * * *